US012290219B2

(12) United States Patent
Zhang et al.

(10) Patent No.: US 12,290,219 B2
(45) Date of Patent: May 6, 2025

(54) CLEANING APPARATUS AND CONTROL METHOD THEREOF, DEVICE, BASE STATION, SYSTEM, AND STORAGE MEDIUM

(71) Applicants: YUNJING INTELLIGENCE (SHENZHEN) CO., LTD., Shenzhen (CN); YUNJING INTELLIGENCE INNOVATION (SHENZHEN) CO., LTD., Shenzhen (CN)

(72) Inventors: Junbin Zhang, Shenzhen (CN); Qiang Li, Shenzhen (CN)

(73) Assignees: YUNJING INTELLIGENCE (SHENZHEN) CO., LTD., Shenzhen (CN); YUNGJING INTELLIGENCE INNOVATION (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 18/623,006

(22) Filed: Mar. 31, 2024

(65) Prior Publication Data

US 2024/0237868 A1 Jul. 18, 2024

Related U.S. Application Data

(63) Continuation of application No. PCT/CN2022/133543, filed on Nov. 22, 2022.

(51) Int. Cl.
*A47L 11/40* (2006.01)

(52) U.S. Cl.
CPC ..... *A47L 11/4011* (2013.01); *A47L 11/4005* (2013.01); *A47L 11/4088* (2013.01); *A47L 2201/022* (2013.01)

(58) Field of Classification Search
CPC ..... A47L 2201/026; A47L 2201/024; A47L 2201/022; H02J 7/00; H02J 50/00;
(Continued)

(56) References Cited

U.S. PATENT DOCUMENTS 11,161,753 B1 11/2021 Wang et al.
2022/0322904 A1 10/2022 Conrad

FOREIGN PATENT DOCUMENTS

CN 107851354 A 3/2018
CN 207460524 U 6/2018
(Continued)

OTHER PUBLICATIONS

International Search Report issued in corresponding International application No. PCT/CN2022/133543, mailed Aug. 18, 2023 (10 pages).

(Continued)

*Primary Examiner* — Eric J Rosen
*Assistant Examiner* — Sharonda T Felton

(57) ABSTRACT

A cleaning apparatus and a control method thereof, a device, a base station, a system, and a storage medium are provided in embodiments of the disclosure. The cleaning system at least includes a cleaning apparatus and a first base station for being used in cooperation with the cleaning apparatus. The cleaning apparatus includes a first energy storage and a first electrical connector connected with the first energy storage, and the first base station includes a second electrical connector and a power consumer connected with the second electrical connector. When the cleaning apparatus is docked with the first base station to couple the first electrical connector with the second electrical connector, the first energy storage supplies power to the power consumer of the first base station through the first electrical connector and the second electrical connector.

18 Claims, 12 Drawing Sheets

(58) Field of Classification Search
CPC . H02J 50/40; H02J 50/50; H02J 50/10; B60K 2360/47; H01F 38/14
USPC ..... 320/109, 115
See application file for complete search history.

(56) References Cited

FOREIGN PATENT DOCUMENTS

| | | | |
|---|---|---|---|
| CN | 215502768 | U | 1/2022 |
| CN | 215914425 | U | 3/2022 |
| CN | 114726305 | A | 7/2022 |
| CN | 217524990 | U | 10/2022 |
| CN | 217610822 | U | 10/2022 |
| WO | 2022075610 | A1 | 4/2022 |

OTHER PUBLICATIONS

Written Opinion of the International Search Authority in corresponding International application No. PCT/CN2022/133543, mailed Aug. 18, 2023 (8 pages).
International Search Report issued in corresponding International application No. PCT/CN2022/133543, mailed Aug. 18, 2023 (5 pages).
Written Opinion of the International Search Authority in corresponding International application No. PCT/CN2022/133543, mailed Aug. 18, 2023 (4 pages).

CLEANING APPARATUS AND CONTROL METHOD THEREOF, DEVICE, BASE STATION, SYSTEM, AND STORAGE MEDIUM

TECHNICAL FIELD

The disclosure relates to the technical field of cleaning, in particular to a cleaning apparatus and a control method thereof, a device, a base station, a system, and a storage medium.

BACKGROUND

With continuous improvements of people's cleaning requirements and cleaning technologies, cleaning robots are becoming increasingly popular. For example, the cleaning apparatuses can be configured to clean and maintain floors, tiles, marble, and other hard grounds. In related art, a base station is commonly provided for the cleaning apparatus. The base station can charge the cleaning apparatus, and clean and perform other maintenance operations on the cleaning apparatus. However, the base station is bulky and needs to be connected to a power supply, resulting a less flexible installation position.

SUMMARY

The present disclosure provides a cleaning apparatus and a control method thereof, a device, a base station, a system, and a storage medium, which can at least facilitate installation and use of a cleaning system.

In a first aspect, a cleaning system is provided in an embodiment of the present disclosure, which includes:

a cleaning apparatus for cleaning a surface to be cleaned, the cleaning apparatus including a first energy storage and a first electrical connector connected with the first energy storage; and a first base station configured to be in cooperation with the cleaning apparatus, the first base station including a second electrical connector. The first base station is configured to:

be in fluid communication with an external water source to allow liquid from the external water source to be input into the cleaning system; and/or be in fluid communication with an external drainage to output dirt in the cleaning system to the external drainage;

wherein in case the cleaning apparatus is docked with the first base station to couple the first electrical connector with the second electrical connector, the first energy storage is capable of supplying power to the first base station through the first electrical connector and the second electrical connector.

In a second aspect, a cleaning system is provided in an embodiment of the present disclosure, which includes:

a cleaning apparatus for cleaning a surface to be cleaned, the cleaning apparatus including a first energy storage and a first electrical connector connected with the first energy storage; and a first base station configured to be in cooperation with the cleaning apparatus, the first base station including a second electrical connector and a power consumer connected with the second electrical connector;

wherein in case the cleaning apparatus is docked with the first base station to couple the first electrical connector with the second electrical connector, the first energy storage supplies power to the first base station through the first electrical connector and the second electrical connector.

In a third aspect, a cleaning apparatus is provided in an embodiment of the present disclosure. The cleaning apparatus is configured to clean a surface to be cleaned, and includes a first energy storage and a first electrical connector connected with the first energy storage.

In case the cleaning apparatus is docked with the first base station to couple the first electrical connector with the second electrical connector of the first base station, the first energy storage supplies power to the first base station through the first electrical connector and the second electrical connector.

In a fourth aspect, a base station is provided in an embodiment of the present disclosure. The base station is configured to be in cooperation with a cleaning apparatus and includes a second electrical connector, and the base station is further configured to:

be in fluid communication with a water source to allow liquid from the external water source to be input into the cleaning system; and/or be in fluid communication with an external drainage to output dirt in the cleaning system to the external drainage.

In case the base station is docked with the cleaning apparatus to couple the second electrical connector with a first electrical connector of the cleaning apparatus, the base station obtains electrical energy output by the cleaning apparatus via the first electrical connector, through the second electrical connector.

In a fifth aspect, a base station is provided in an embodiment of the present disclosure. The base station is used in cooperation with cleaning apparatus, and includes a solar power generator and a power consumer connected with the solar power generator.

The solar power generator is configured to convert solar energy into electrical energy and provide the solar energy to the power consumer.

In a sixth aspect, a control method of a cleaning system is provided in an embodiment of the present disclosure, which is applied to the cleaning system described above, and the method includes:

in response to the cleaning apparatus being docked with the first base station to couple the first electrical connector of the cleaning apparatus with the second electrical connector of the first base station, controlling the first electrical connector and/or the second electrical connector to allow the first energy storage of the cleaning apparatus to supply power to the first base station through the first electrical connector and the second electrical connector.

In a seventh aspect, a control method of a cleaning system is provided in an embodiment of the disclosure, which is applied to a cleaning system. The cleaning system includes a cleaning apparatus, a first base station, and a second base station, and the second base station can be connected with commercial power.

The method includes:

controlling the cleaning apparatus to move to the first base station to be docked with the first base station, or prompting a user to move the cleaning apparatus to the first base station to be docked with the first base station in case a state of the cleaning apparatus meets a water circulation condition, and controlling the first base station to perform a water circulation operation on the cleaning apparatus; and controlling the cleaning apparatus to move to the second base station to be docked with the second base station, or prompting a user to move the cleaning apparatus to the second base station to be docked with the second base station in case a state of the cleaning apparatus meets a charging condition, to allow the second base station to charge the cleaning apparatus.

In an eighth aspect, a controller is provided in an embodiment of the present disclosure, which includes a memory and a processor.

The memory is configured to store executable instructions.

The processor is configured to execute the instructions to implement:

steps of the control method of the cleaning apparatus described above.

In a ninth aspect, a computer-readable storage medium is provided in an embodiment of the present disclosure. The computer-readable storage medium stores computer executable instructions, which, when executed by a processor, causes the processor to realize steps of the method described above.

A cleaning apparatus and a control method thereof, a device, a base station, a system, and a storage medium are provided in embodiments of the disclosure. The cleaning system at least includes a cleaning apparatus for cleaning a surface to be cleaned and a first base station for being used in cooperation with the cleaning apparatus. The cleaning apparatus includes a first energy storage and a first electrical connector connected with the first energy storage, and the first base station includes a second electrical connector and a power consumer connected with the second electrical connector. In case the cleaning apparatus is docked with the first base station to couple the first electrical connector with the second electrical connector, the first energy storage supplies power to the first base station through the first electrical connector and the second electrical connector. The cleaning apparatus can supply electrical energy stored therein to the first base station in case the cleaning apparatus is docked with the first base station, such that the first base station can be powered without seeking a socket. In addition, it is not necessary for the first base station to be provided with an alternating current-direct current (AC-DC) adapter, which is low cost and occupied space and weight reduced, thus the first base station can be disposed more flexibly and can be installed and used more conveniently.

It should be understood that both the above general description and the following detailed description are exemplary and explanatory only, and cannot limit disclosure of the embodiments of the present application.

BRIEF DESCRIPTION OF DRAWINGS

In order to illustrate the technical schemes in embodiments of the present disclosure more clearly, the accompanying drawings will be briefly introduced below. Obviously, the accompanying drawings in the following description are some of the embodiments of the present disclosure, and other drawings can be obtained according to these drawings by those of ordinary skill in the art without creative effort.

REFERENCE NUMERALS

100, Cleaning Apparatus; 110, First Energy storage; 120, First Electrical Connection Part; 121, First Electrical Connection; 122, First Electrical Energy Transmission Circuit; 123, Second Electrical Energy Transmission Circuit; 124, First Wireless power transmitter; 130, Clear Water Chamber; 140, Recovery Chamber;

200, First Base Station; 210, Second Electrical connector; 211, Second Electrical Connection Part; 212, Second Wireless power transmitter; 220, Power consumer; 221, Waterway controller; 222, Detector; 223, Display; 224, Communication Assembly; 230, Cleaning area; 231, Liquid Inputting Path; 232, Liquid Discharge Path; 240, Second Energy storage; 250, Power supply path selecting circuit; 201, External Water source; 202, External Drainage;

300, Second Base Station; 310, Third Electrical connector; 311, Third Electrical connection Part; 312, Third Wireless power transmitter;

400, Controller; 401. Processor; 402, Memory;

500, Base Station; 510, Solar Power Generator; 520, Power consumer.

DESCRIPTION OF EMBODIMENTS

In the following, technical schemes in embodiments of the disclosure will be described clearly and completely in connection with the attached drawings of the embodiments of this disclosure; obviously, the described embodiments are intended to be a part of the embodiments of the disclosure, but not all of them. On a basis of the embodiments in this disclosure, all other embodiments obtained by the ordinary skilled in the art without any creative effort are within the protection scope of this disclosure.

Flow charts shown in the attached drawings is only for illustration, and it is not necessary to include all of contents and operations/steps, nor to execute them in a described order. For example, some of the operations/steps can be decomposed, combined, or partially merged, and thus an actual execution order of them may varies according to actual situations.

Figure 1A:
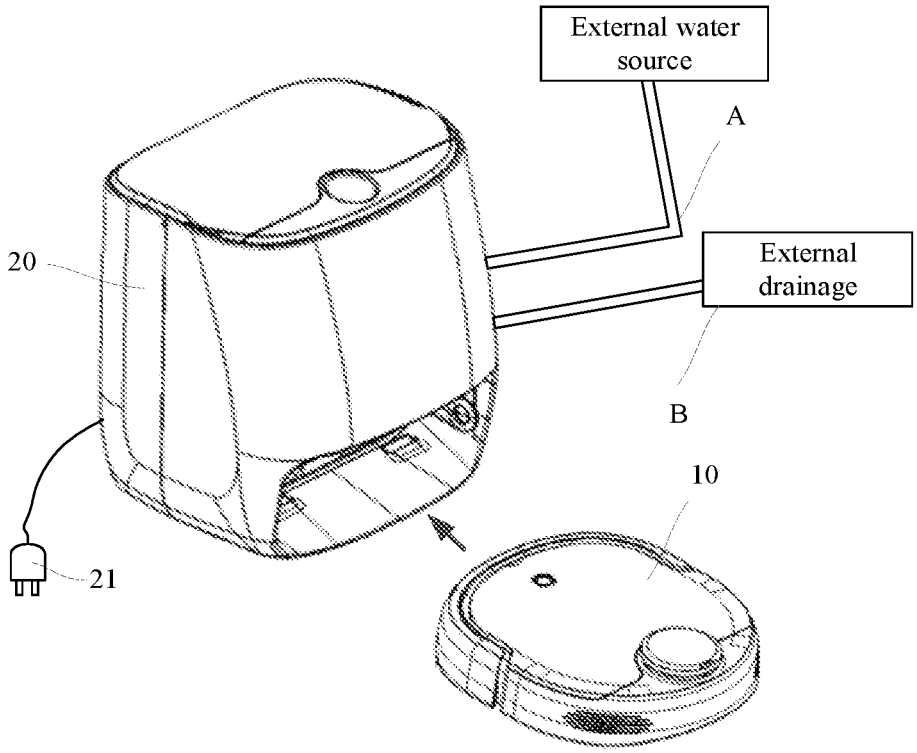
FIG. 1A is a schematic diagram of a cleaning system in which a cleaning apparatus is driven to a base station according to related art.
Figure 1B:
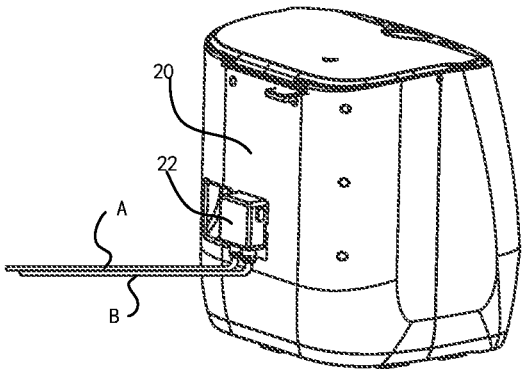
FIG. 1B is a schematic diagram of connection of a base station with an external water pipe and a sewage discharge pipe according to the related art.

Referring to FIG. 1A and FIG. 1B, FIG. 1A is a schematic diagram of a cleaning system in which a cleaning apparatus 10 travels to a base station 20 according to related art, and FIG. 1B is a schematic diagram of connection of a base station 20 with an external water pipe A and a sewage discharge pipe B according to related art. In the related art, the cleaning apparatus 10, such as a cleaning robot, is usually used in cooperation with the base station 20. The base station 20 can charge, clean, replenish clean water to, discharge sewage of and perform other operations on the cleaning apparatus 10. The base station 20 obtains power from commercial power by plugging a plug 21 into a socket. The base station 20 can be connected to an external water source, such as a tap water supply end, through an external water pipe A, and can be communicated with an external drainage, such as a sewer, through an external sewage pipe B. The base station 20 is provided with a clean water chamber for temporarily storing clean water from the external water source and a recovery chamber for temporarily storing dirt to be discharged to the external drainage. The base station 20 is provided with a power supply member, and the cleaning apparatus 10 is provided with a charging member. When the cleaning apparatus 10 docks at a preset docking position on the base station 20, the charging member of the cleaning apparatus 10 is in contact with the power supply member of the base station 20, so that the base station 20 charges a battery of the cleaning apparatus 10. In addition, the base station 20 also supplies electrical energy obtained from the commercial power to the power consumer 22 (such as a valve/pump) on the base station 20, to control on/off and flow of a waterway.

The cleaning apparatus 10 can be configured to mop a floor. After the cleaning apparatus 10 mops the room floor for a period of time and a mop of the cleaning apparatus 10 becomes dirty, the cleaning apparatus 10 travels to the base station 20. The cleaning apparatus 10 enters the base station 20 through an entrance of the base station 20 and docks at the preset docking position on the base station 20, allowing the mop of the cleaning apparatus 10 to be accommodated in a cleaning tank, and by way of the valve and the pump, the base station 20 supplies clean water from the external water source (for example, a faucet) to the cleaning tank via a water pipe to clean the mop, and discharges dirty sewage after cleaning the mop from the cleaning tank to the external drainage (for example, a floor drain) via a sewage pipe.

Because it is necessary to connect both the power supply and water supply, considering an installation size, safety, and other factors, the base station 20 is generally installed near the socket (such as in a living room), and then connected to the faucet and the floor drain of a bathroom/balcony through a long water pipe, which has high requirements on an installation environment, resulting in inconvenience for users to install. With creative effort, the inventors of the present disclosure provide a solution for facilitating installation of the base station 20. The solution at least involves a base station 20 that does not need to be connected to an AC socket for power and a cleaning apparatus 10 capable of supplying power to the base station 20. The solution also provides an improved cleaning system including the base station 20 and the cleaning apparatus 10, and an improved control method of the cleaning system, so as to at least facilitate installation and use of the cleaning system.

Some embodiments of the present application will be described in detail with reference to the drawings. In a case of no conflict, the following embodiments and features in the embodiments can be combined with each other.

Figure 2:
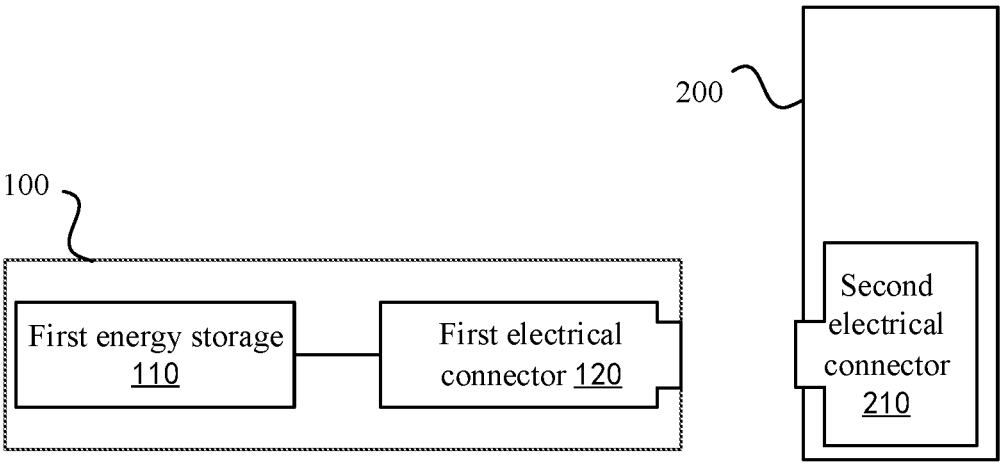
FIG. 2 is a schematic block diagram of a cleaning system according to an embodiment of the present disclosure.

Reference is made to FIG. 2, which is a schematic block diagram of a cleaning system according to an embodiment of the present disclosure. The cleaning system includes a cleaning apparatus 100 and a first base station 200. The embodiments of the present disclosure further provide the cleaning apparatus 100 and the first base station 200.

As shown in FIG. 2, the cleaning system according to the embodiment of the present disclosure includes a cleaning apparatus 100 and a first base station 200, and the first base station 200 is used in cooperation with the cleaning apparatus 100.

The first base station 200 is configured to perform at least one of the following tasks: supplying clean water to the cleaning apparatus 100, discharging sewage or solid dirt stored in the cleaning apparatus 100, and cleaning or replacing cleaning members of the cleaning apparatus 100, which is of course not limited thereto.

The cleaning apparatus 100 is configured to clean a surface to be cleaned. For example, the cleaning apparatus 100 may be a hand-held cleaning apparatus, such as a hand-held vacuum cleaner, a hand-held mopping machine, or an automatic cleaning apparatus, such as a cleaning robot and a cleaning vehicle. For convenience of explanation, embodiments of this disclosure are illustrated mainly by taking the cleaning robot as an example.

Figure 3:
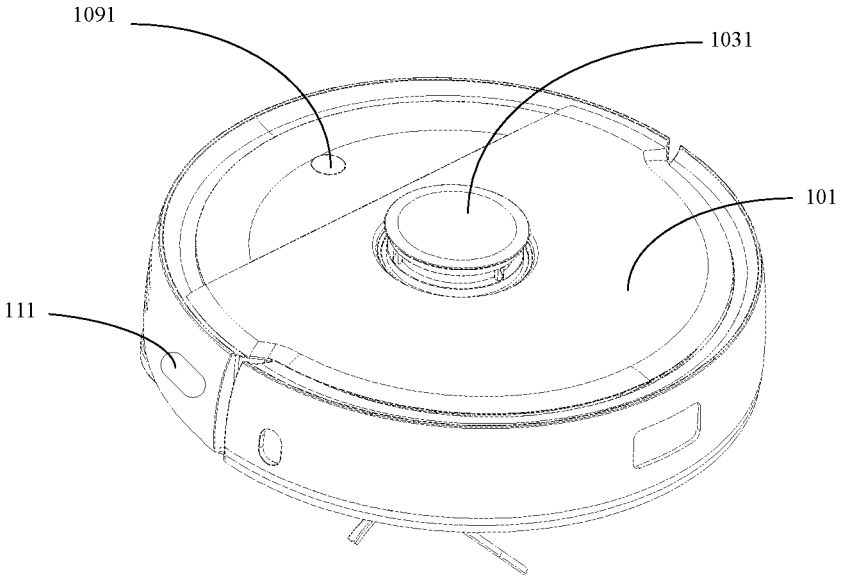
FIG. 3 is a perspective view of a cleaning robot according to an embodiment of the present disclosure.
Figure 4:
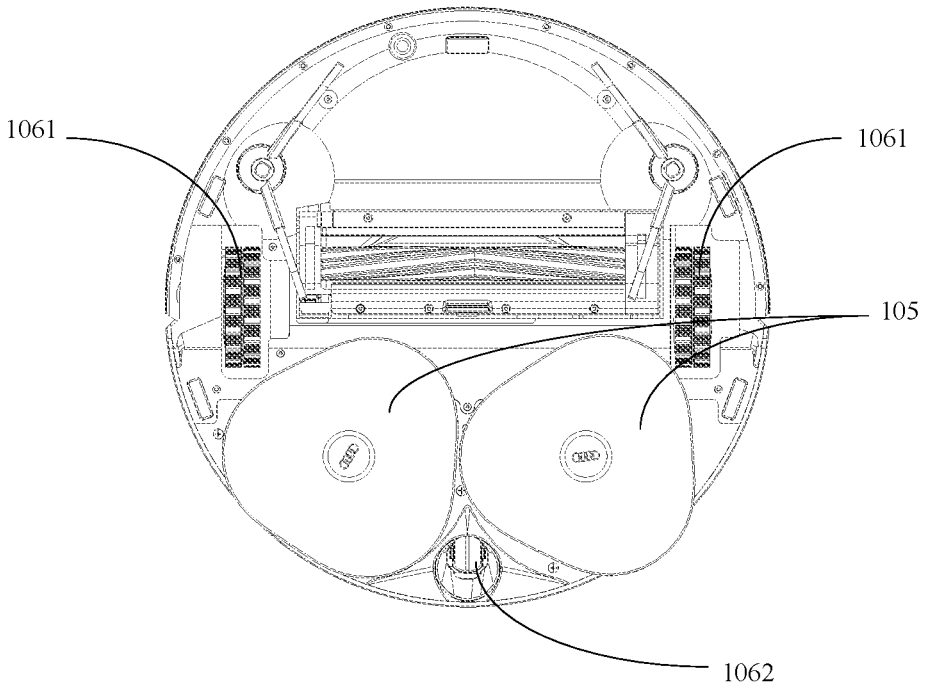
FIG. 4 is a bottom view of the cleaning robot shown in FIG. 2.
Figure 5:
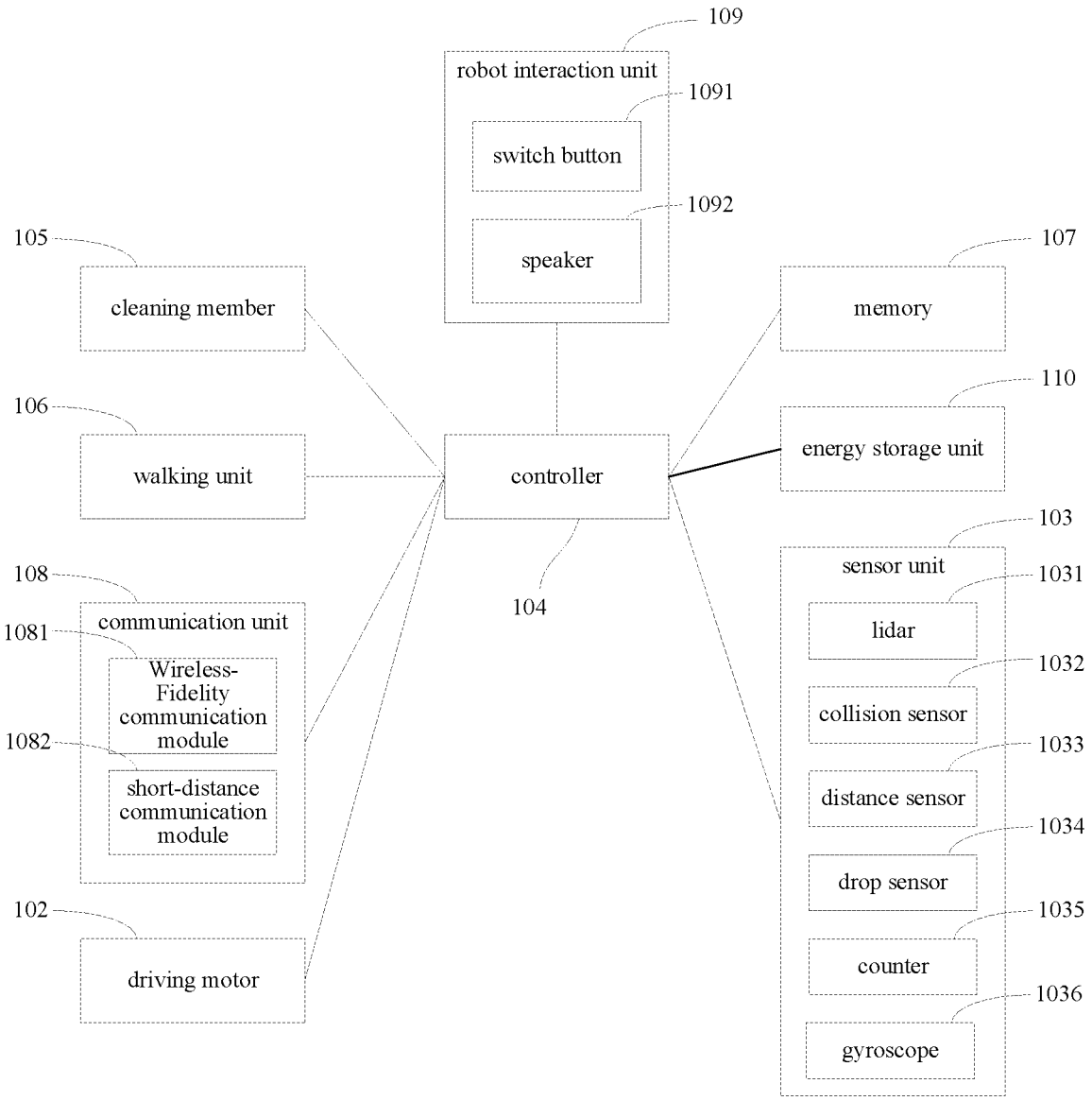
FIG. 5 is another schematic structural diagram of the cleaning robot shown in FIG. 2.

FIG. 3 is a perspective view of a cleaning robot 100 according to an embodiment of the present disclosure, FIG. 4 is a bottom view of the cleaning robot 100 shown in FIG. 3, and FIG. 5 is another schematic structural diagram of the cleaning robot 100 shown in FIG. 2.

As shown in FIG. 3 to FIG. 5, the cleaning robot 100 includes a robot body 101, a driving motor 102, a sensor unit 103, a controller 104, an energy storage 110, a walking unit 106, a memory 107, a communication unit 108, a robot interaction unit 109, a cleaning member 105, and a charging part 111.

The cleaning member 105 may be used to clean the ground, and there may be one or more cleaning members 105. The cleaning member 105 includes, for example, a mop. For example, the mop includes at least one of: a rotary mop, a flat mop, a roller mop, a track-type mop, etc., which is of course not limited to this. The mop is arranged at a bottom of the robot body 101, in particular, at a rear position at the bottom of the robot body 101. Taking the cleaning member as the rotary mop as an example, the driving motor 102 is arranged inside the robot body 101, two rotating shafts extend from the bottom of the robot body 101, and a mop is sleeved on each rotating shaft. The driving motor 102 can drive the rotating shafts to rotate, so that the rotating shaft drives the mop to rotate.

The walking unit 106 is a component related to movement of the cleaning robot 100, and includes a driving wheel 1061 and a universal wheel 1062. The universal wheel 1062 and the driving wheel 1061 cooperate to realize steering and movement of the cleaning robot 100.

The controller 104 is arranged inside the robot body 101, and is configured to control the cleaning robot 100 to perform specific operations. The controller 104 may be, for example, a Central Processing Unit (CPU), a Microprocessor, or the like. As shown in FIG. 4, the controller 104 is electrically connected with the energy storage 110, the memory 107, the driving motor 102, the walking unit 106, the sensor unit 103, the robot interaction unit 109, and the cleaning member 105 so as to control these components.

The energy storage 110 is arranged inside the robot body 101, and the energy storage 110 is configured to store electrical energy and supply electrical energy to electrical components of the cleaning robot 100. The energy storage 110 may include, for example, at least one of: a battery, a supercapacitor, a flywheel energy storage, etc.

The robot main body 101 is also provided with a charging part 111. The charging part 111 is configured to obtain power from an external apparatus, so as to charge the energy storage 110 of the cleaning robot 100. The charging part 111 may include, for example, butt contacts, charging poles, or wireless charging coils.

A memory 107 is provided on the robot body 101, with computer executable instructions stored thereon. The computer executable instructions, when executed by the controller 104, implement corresponding operations. The memory 107 is further configured to store parameters for the cleaning robot 100. The memory 107 includes, but is not limited to, a disk memory, a Compact Disc Read-Only Memory (CD-ROM), an optical memory, or the like.

The communication unit 108 is arranged on the robot main body 101, and is configured for the cleaning robot 100 to be communicated with external devices. The communication unit 108 includes, but is not limited to, a Wireless-Fidelity (WI-FI) communication module 1081 and a short-distance communication module 1082. The cleaning robot 100 can be connected to a WI-FI router through the WI-FI communication module 1081, so as to be communicated with terminals. The cleaning robot 100 is communicated with the base station through the short-distance communication module 1082. The base station is a cleaning apparatus used in cooperation with the cleaning robot 100.

The sensor unit 103 arranged on the robot body 101 includes various types of sensors, such as a lidar 1031, a collision sensor 1032, a distance sensor 1033, a drop sensor 1034, a counter 1035, a gyroscope 1036, or the like.

The robot interaction unit 109 is arranged on the robot body 101, and a user can interact with the cleaning robot 100 through the robot interaction unit 109. The robot interaction unit 109 includes, for example, a switch button 1091 and a speaker 1092. The user can control the cleaning robot 100 to start or stop operation by pressing the switch button 1091. The cleaning robot 100 can play a prompt message to the user through the speaker 1092.

It should be understood that the cleaning robot 100 described in the embodiment of the present disclosure is only a specific example, and does not constitute specific limitation on the cleaning robot 100, and the cleaning robot 100 can also be other specific forms, for example, the cleaning apparatus may have more or fewer parts than the cleaning robot 100 shown in FIG. 2. For example, the cleaning apparatus may include a clean water chamber for storing clean water and/or a recovery chamber for storing dirt. The cleaning apparatus may transport the clean water stored in the clean water chamber to the mop and/or the floor to wet the mop, and clean the floor using the wet mop. The cleaning apparatus may also collect dirt on the floor or sewage containing dirt into the recovery chamber. The cleaning apparatus can also convey the clean water stored in the clean water chamber to the mop to clean the mop, and the sewage containing dirt after cleaning the mop can also be conveyed to the recovery chamber.

As shown in FIG. 2, the cleaning apparatus 100 includes a first energy storage 110 and a first electrical connector 120 connected with the first energy storage 110. For example, the first energy storage 110 may include, but is not limited to, at least one of: a battery, a supercapacitor, a flywheel energy storage, etc., as long as it can realize storage of power obtained from external devices by the charging part 111 of the cleaning robot 100, thereby providing power for the cleaning robot 100. The first electrical connector 120 is configured to couple with external electrical connector, so that electrical energy can be transmitted between the cleaning apparatus 100 and external apparatus (such as a base station for servicing the cleaning apparatus 100). The first electrical connector 120 is connected with the first energy storage 110, so that electrical energy can be transmitted between the first electrical connector 120 and the first energy storage 110.

As shown in FIG. 2, the first base station 200 includes a second electrical connector 210. The second electrical connector 210 is configured to receive electrical energy from the first electrical connector 120 in case the cleaning apparatus 100 is docked with the first base station 200 to couple the first electrical connector 120 with the second electrical connector 210, so that the first energy storage 110 of the cleaning apparatus 100 can supply power to the first base station 200 through the first electrical connector 120 and the second electrical connector 210.

Illustratively, the first base station 200 can perform at least one of following tasks based on the electrical energy obtained from the cleaning apparatus 100: supplying the clean water to the cleaning apparatus 100, discharging the sewage or solid dirt stored in the cleaning apparatus 100, and cleaning or replacing cleaning components of the cleaning apparatus 100, which is of course not limited thereto.

In some embodiments, the first base station 200 includes a power consumer 220. The power consumer 220 includes electrical components of the first base station 200, which may be but not limited to, waterway control components such as pumps and valves, mop cleaning mechanisms such as electrical scrubbers and dryers, sensors, controllers, communication components, etc.

Figure 6A:
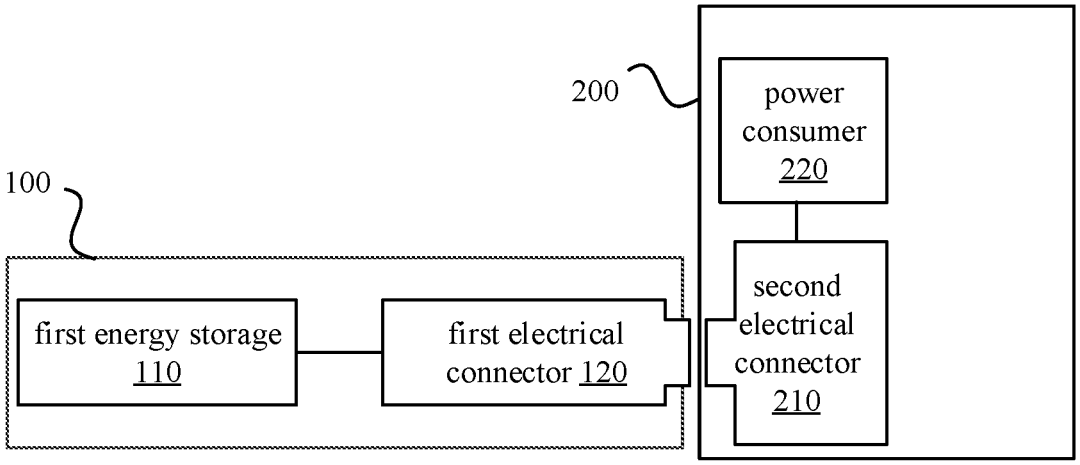
FIG. 6A is a schematic diagram of a cleaning apparatus being docked with a first base station according to some embodiments of the present disclosure.

Illustratively, as shown in FIG. 6A, the power consumer 220 is connected with the second electrical connector 210. In case the cleaning apparatus 100 is docked with the first base station 200 to couple the first electrical connector 120 with the second electrical connector 210, the first energy storage 110 can supply power to the power consumer 220 of the first base station 200 through the first electrical connector 120 and the second electrical connector 210. In such a way, the second electrical connector 210 obtains electrical energy output by the first electrical connector 120 and supplies the electrical energy to the power consumer 220.

In some embodiments, the first base station 200 further includes a second energy storage 240. The second energy storage 240 can receive and store electrical energy from the second electrical connector 210 and can supply power to the power consumer 220. For example, the first energy storage 240 may include, but is not limited to, at least one of: a battery, a supercapacitor, a flywheel energy storage, etc.

Figure 6B:
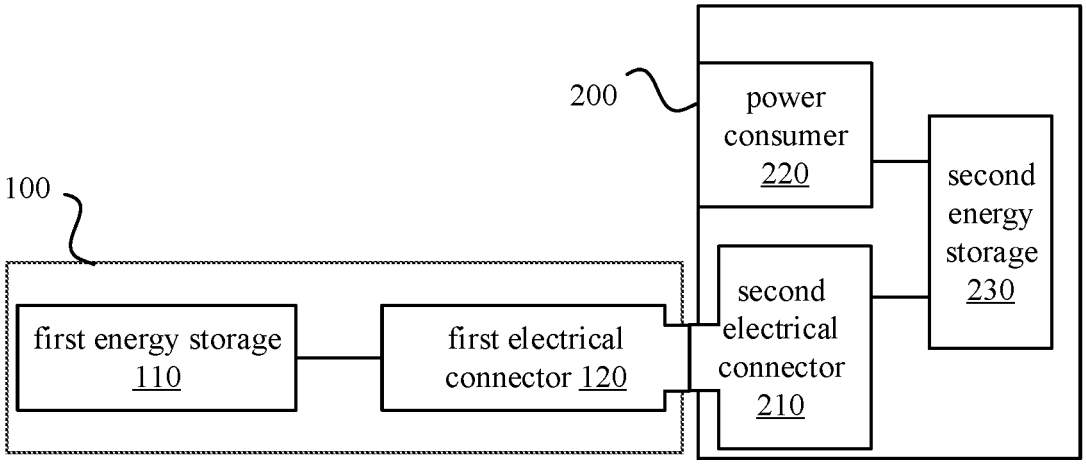
FIG. 6B is a schematic diagram of a cleaning apparatus being docked with a first base station according to some embodiments of the present disclosure.

Illustratively, as shown in FIG. 6B, the second energy storage 230 is connected with the second electrical connector 210 and the power consumer 220. In case the cleaning apparatus 100 is docked with the first base station 200 to couple the first electrical connector 120 with the second electrical connector 210, the first energy storage 110 can supply power to the second energy storage 230 of the first base station 200 through the first electrical connector 120 and the second electrical connector 210, so that the second energy storage 230 can store the electrical energy from the cleaning apparatus 10 and supply power to the power consumer 220.

Figure 6C:
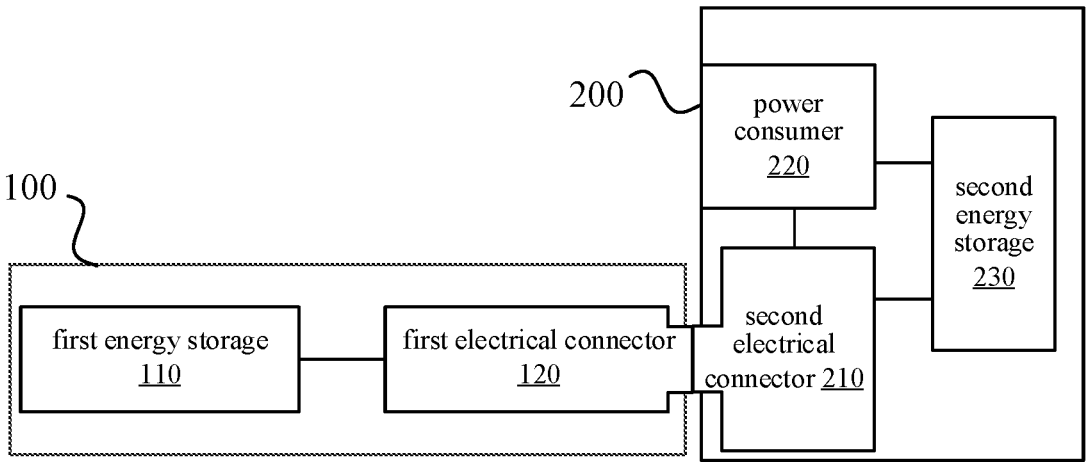
FIG. 6C is a schematic diagram of a cleaning apparatus being docked with a first base station according to some embodiments of the present disclosure.

Illustratively, as shown in FIG. 6C, the second energy storage 230 is connected with the second electrical connector 210 and the power consumer 220, and the power consumer 220 is connected with the second electrical connector 210. In case the cleaning apparatus 100 is docked with the first base station 200 to couple the first electrical connector 120 with the second electrical connector 210, the first energy storage 110 can supply power to the second energy storage 230 of the first base station 200 through the first electrical connector 120 and the second electrical connector 210, so that the second energy storage 230 can store the electrical energy from the cleaning apparatus 10 and supply power to the power consumer 220. In addition, the first energy storage 110 can also directly supply power to the power consumer 220 of the first base station 200 through the first electrical connector 120 and the second electrical connector 210. It can be understood that the electrical energy for the power consumer 220 can be supplied by the second energy storage 230, or by the second electrical connector 210, or a part of the electrical energy by the second energy storage 230 and the other part of the electrical energy by the second electrical connector 210.

In such a way, the cleaning apparatus 100 can supply power to the first base station 200, and it is not necessary to provide a socket for the first base station to power the first base station, so that the first base station can be disposed more flexibly and can be installed and used more conveniently. The cleaning apparatus 100 may move to the first base station 200 to be docked with the first base station 200 by its own, or the cleaning apparatus 100 may be moved to the first base station 200 to be docked with the first base station 200 by a user.

It should be noted that the cleaning apparatus 100 being docked with the first base station 200 means that the cleaning apparatus 100 is docked at a preset docking position on the first base station 200, such that the first electrical connector 120 and the second electrical connector 210 can be in contact and coupled with each other to realize power transmission. For example, a conductor (such as an electrode pad) of the first electrical connector 120 is in contact with a conductor (such as an electrode pad) of the second electrical connector 210 so as to transmit power. Or, the first electrical connector 120 and the second electrical connector 210 are non-contact coupled with each other to realize power transmission; for example, a distance between a wireless power transmission component (such as a coil) of the first electrical connector 120 and a wireless power transmission component (such as a coil) of the second electrical connector 210 is within a preset range at which wireless power transmission can be realized. A wireless power transmission mode, that is, non-contact power transmission, can be electromagnetic-inducted wireless power transmission, magnetic resonance wireless power transmission, electric field coupling wireless power transmission, microwave power transmission, etc.

Figure 7:
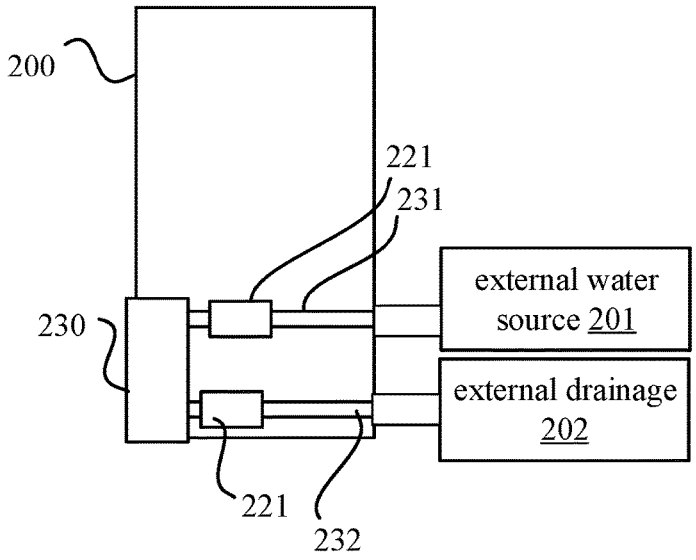
FIG. 7 is a schematic block diagram of a first base station according to an embodiment of the present disclosure.

In some embodiments, referring to FIG. 7, the first base station 200 is configured to be in fluid communication with an external water source 201 to input liquid from the external water source 201 into the cleaning system; and/or be in fluid communication with the external drainage 202 to output dirt in the cleaning system to the external drainage 202.

In some embodiments, as shown in FIG. 7, the power consumer 220 of the first base station 200 includes a waterway controller 221. For example, the waterway controller 221 is configured to transport the liquid from the external water source 201 to the cleaning system, and/or the waterway controller 221 is configured to transport the dirt in the cleaning system to the external drainage 202. The external water source 201 includes but is not limited to a municipal water supply (such as a faucet), and the external drainage 202 includes but is not limited to an external sewer outside of the first base station 200.

Illustratively, the first base station 200 can be in fluid communication with the external water source 201 and/or the external drainage 202, in which fluid communication means that liquid can flow between the first base station 200 and the external water source 201, and/or between the first base station 200 and the external drainage 202. For example, the waterway controller 221 is configured to transport the liquid from the external water source 201 to the cleaning apparatus 100 and/or the first base station 200; and/or the waterway controller 221 is configured to transport the dirt in the cleaning apparatus 100 and/or the first base station 200 to the external drainage 202.

Illustratively, as shown in FIG. 7, the first base station 200 includes a cleaning area 230. The cleaning area 230 can be configured to clean cleaning members (such as mops or sweeping parts) of the cleaning apparatus 100, and/or for cleaning the walking unit (such as a wheel) of the cleaning apparatus 100, and/or for self-cleaning of the first base station 200, which is of course not limited thereto. For convenience of explanation, embodiments of this disclosure are illustrated mainly by taking the cleaning area 230 being configured to clean the mop of the cleaning apparatus 100 as an example. For example, the cleaning area 230 of the first base station 200 is provided with a cleaning tank, and the cleaning tank is provided with cleaning ribs, which can scrape and clean the mop of the cleaning apparatus 100.

The waterway controller 221 is configured to transport the liquid from the external water source 201 to the cleaning area 230 of the first base station 200. Illustratively, as shown in FIG. 7, the first base station 200 includes a liquid inputting path 231 fluidly communicated to the external water source 201 and the cleaning area 230, the waterway controller 221 includes a pump and/or a valve provided in the liquid inputting path 231, and the pump and/or the valve is configured to control input of the liquid from the external water source 201 into the cleaning area 230 of the first base station 200 through the liquid inputting path 231. Input of water into the cleaning area 230 can be made by supplying water to the cleaning area 230 or directly spraying water to parts to be cleaned in the cleaning area 230, which is not limited herein.

The waterway controller 221 is also configured to transport the dirt in the cleaning area 230 to the external drainage 202. The clean water transported to the cleaning area 230 can serve to clean the mop to generate dirty water containing dirt, and the waterway controller 221 can be controlled to transport the dirt in the cleaning area 230 to the external drainage 202. Illustratively, as shown in FIG. 7, the first base station 200 includes a liquid discharge path 232 fluidly communicated to the cleaning area 230 and the external drainage 202, the waterway controller 221 includes a pump and/or a valve provided in the liquid discharge path 232, and the pump and/or the valve is configured to control to transport the dirt in the cleaning area 230 to the external drainage 202 through the liquid discharge path 232.

As shown in FIG. 7, flow of liquid between the first base station 200 and the external water source 201 and/or the external drainage 202 can be controlled by controlling the valve and/or the pump.

Figure 8:
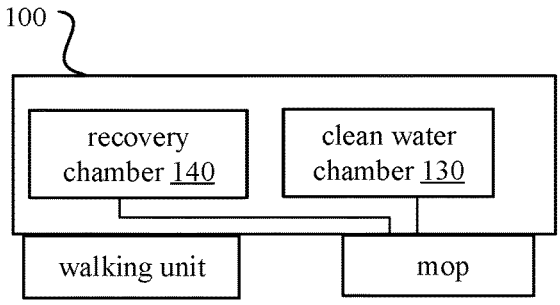
FIG. 8 is a schematic block diagram of a cleaning apparatus according to another embodiment of the present disclosure.

Illustratively, in some embodiments, as shown in FIG. 8, the cleaning apparatus 100 includes a clean water chamber 130 for storing clean water and/or a recovery chamber 140 for storing dirt.

For example, the first base station 200 includes the liquid inputting path 231 fluidly communicated to the external water source 201 and the clean water chamber 130, the waterway controller 221 includes the pump and/or the valve provided in the liquid inputting path 231, and the pump and/or the valve is configured to input the liquid from the external water source 201 to the clean water chamber 130 of the cleaning apparatus 100 through the liquid inputting path 231.

For example, the first base station 200 includes the liquid discharge path 232 fluidly communicated to the recovery chamber 140 and the external drainage 202, the waterway controller 221 includes a pump and/or a valve arranged in the liquid discharge path 232, and the pump and/or the valve is configured to transport the dirt in the recovery chamber 140 of the cleaning apparatus 100 to the external drainage 202 through the liquid discharge path 232.

Illustratively, referring to FIG. 7 and FIG. 8, the first base station 200 includes a cleaning area 230, and the cleaning apparatus 100 includes a clean water chamber 130 for storing clean water. The first base station 200 includes the liquid inputting path 231 fluidly communicated to the external water source 201 and the cleaning area 230, the liquid inputting path 231 is further configured to be fluidly communicated to the external water source 201 and the clean water chamber 130, and the pump and/or the valve is further configured to input the liquid from the external water source 201 to the clean water chamber 130 of the cleaning apparatus 100 through the liquid inputting path 231.

Illustratively, referring to FIG. 7 and FIG. 8, the first base station 200 includes a cleaning area 230, and the cleaning apparatus 100 further includes a recovery chamber 140 for storing dirt. The first base station 200 includes the liquid discharge path 232 fluidly communicated to the cleaning area 230 and the external drainage 202. The liquid discharge path 232 is further configured to be fluidly communicated to the recovery chamber 140 and the external drainage 202, and the pump and/or the valve is further configured to output the dirt in the recovery chamber 140 of the cleaning apparatus 100 to the external drainage 202 through the liquid discharge path 232.

It can be understood that the liquid inputting path 231 and the liquid discharge path 232 include, but are not limited to, liquid channels, pipelines, interfaces, cavities, etc. provided in the first base station 200. The first base station 200 may be in fluid communication with the external water source 201 and/or the external drainage 202 through an external pipeline, such that the liquid inputting path 231 and the liquid discharge path 232 are respectively in communication with the external pipeline and the cleaning area 230/the clean water chamber 130 of the cleaning apparatus 100/the recovery chamber 140 of the cleaning apparatus 100, so that liquid can flow between the cleaning area 230 of the first base station 200/the clean water chamber 130/the recovery chamber 140 and the external water source 201 and/or the external drainage 202. Of course, it is not limited to this, and no pipeline can be arranged between the first base station 200 and the external water source 201 and/or the external drainage 202. For example, the first base station 200 is disposed above the external drainage 202 (such as a floor drain), and dirt of the first base station 200 can be directly discharged to the external drainage 202 through the liquid discharge path 232.

The cleaning apparatus 100 can transport the clean water stored in the clean water chamber 130 to the mop and/or the floor for wet cleaning the floor, and the cleaning apparatus 100 can also collect sewage generated in a cleaning process into the recovery chamber 140. The cleaning apparatus 100 can further transport the clean water stored in the clean water chamber 130 to the mop to clean the mop, and sewage obtained after cleaning the mop can also be transported to the recovery chamber 140.

In case the first electrical connector 120 is coupled with the second electrical connector 210, the first energy storage 110 of the cleaning apparatus 100 supplies power to the waterway controller 221 of the first base station 200 through the first electrical connector 120 and the second electrical connector 210, so that the waterway controller 221 can transport the liquid to the clean water chamber 130 of the cleaning apparatus 100 and/or transport the dirt in the recovery chamber 140 of the cleaning apparatus 100 to the external drainage 202. Therefore, based on the electrical energy provided by the cleaning apparatus 100 to the first base station 200, the first base station 200 can supply clean water to the cleaning apparatus 100 and/or discharge the sewage stored in the cleaning apparatus 100.

It can be understood that power for the first base station 200 in the embodiment of the present disclosure comes from the cleaning apparatus 100, without need to connect a socket for power, the first base station 200 can be disposed more flexibly. When it is necessary to be in fluid communication with the external water source and/or the external drainage, the first base station 200 can be installed proximate to the external water source and/or the external drainage, and for example, it can be installed in a bathroom, a kitchen, a balcony, and other areas provided with a municipal water supply and/or a floor drain. In addition, since an AC-DC adapter is not required and it is not necessary to provide a clean water chamber for temporarily storing clean water and/or a sewage chamber for temporarily storing sewage considering that a water supply and/or a floor drain is nearby, the first base station can be made small and thin, which can occupy less or even no extra space in a home environment (for example, an existing space in the home environment can be used so as to directly install the small and thin first base station in a space below the washbasin), and thus the first base station can be disposed more flexibly and can be installed and used more conveniently.

Figure 9:
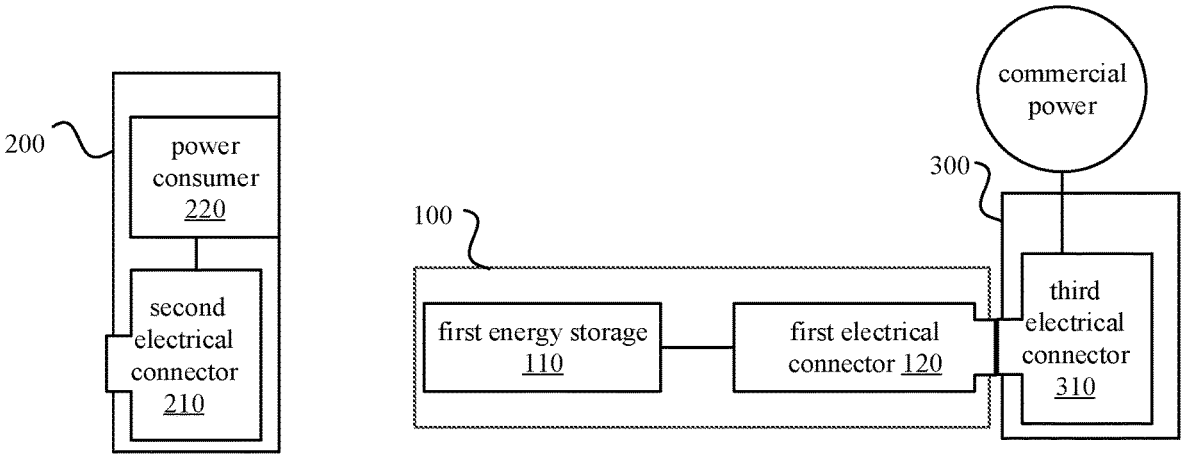
FIG. 9 is a schematic block diagram of a cleaning system according to another embodiment of the present disclosure.

In some embodiments, referring to FIG. 9, the cleaning system further includes a second base station 300, which can be connected to the commercial power, and the second base station 300 is at least configured to charge the cleaning apparatus 100.

Illustratively, the second base station 300 includes a third electrical connector 310. In case the cleaning apparatus 100 is docked with the second base station 300, so as to couple the first electrical connector 120 of the cleaning apparatus 100 with the third electrical connector 310 of the second base station 300, the second base station 300 supplies electrical energy of the commercial power to the first energy storage 110 of the cleaning apparatus 100 through the third electrical connector 310 and the first electrical connector 120, and the first electrical connector 120 of the cleaning apparatus 100 supplies the electrical energy output by the second base station 300 through the third electrical connector 310 to the first energy storage 110 of the cleaning apparatus 100, thus charging the cleaning apparatus 100. It should be noted that implementation for docking the cleaning apparatus 100 with the second base station 300 so as to couple the first electrical connector 120 of the cleaning apparatus 100 with the third electrical connector 310 of the second base station 300 is the same as implementation for docking the cleaning apparatus 100 with the first base station 200 so as to couple the first electrical connector 120 with the second electrical connector 210, which will not be described here again.

With the cleaning apparatus being provided with water circulation by the first base station, a water circulation component can be removed from the second base station, so that a structure of the second base station is simplified, with reduced size and cost. For example, the second base station can be a charging pile with a simple structure, which is convenient to install and use and can charge the cleaning apparatus. The cleaning apparatus can supply its stored electrical energy to the first base station for use, so it is not necessary to provide a socket to the first base station for power and thus the first base station can be disposed more flexibly. When it is necessary to be in fluid communication with the external water source and/or the external drainage, the first base station 200 can be installed proximate to the external water source and/or the external drainage, and for example, it can be installed in a bathroom, a kitchen, a balcony, and other areas provided with a municipal water supply and/or a floor drain. In addition, since an AC-DC adapter is not required and it is not necessary to provide a clean water chamber for temporarily storing clean water and/or a sewage chamber for temporarily storing sewage considering that a water supply and/or a floor drain is nearby, the first base station can be made small and thin, which can occupy less or even no extra space in a home environment (for example, an existing space in the home environment can be used so as to directly install the small and thin first base station in a space below the washbasin), and thus the first base station can be disposed more flexibly and can be installed and used more conveniently. As such, the whole cleaning system is more convenient to install and use.

Figure 18:
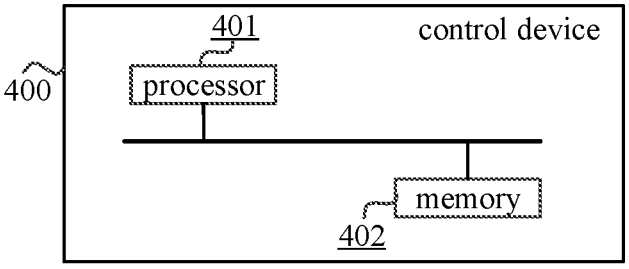
FIG. 18 is a schematic block diagram of a controller of a cleaning system according to an embodiment of the present disclosure.

In some embodiments, the cleaning system further includes a controller 400. An apparatus controller of the cleaning apparatus 100, and/or a base station controller of the first base station 200, and/or a base station controller of the second base station 300 can be used as the controller 400 separately or in cooperation. For example, the controller 400 as shown in FIG. 18 can be provided on the cleaning apparatus 100, or on the first base station 200, or on the second base station 300, which, of course, is not limited thereto. For example, the controller 400 may be a device other than the cleaning apparatus 100, the first base station 200, and the second base station 300, such as a home intelligent terminal, a master controller, or the like.

A control method of a cleaning system is further provided in an embodiment of the disclosure, and the controller 400 can be used to implement steps of a control method of a cleaning robot according to the embodiment of the disclosure.

Illustratively, in case the cleaning apparatus 100 is docked with the first base station 200 so as to couple the first electrical connector 120 of the cleaning apparatus 100 with the second electrical connector 210 of the first base station 200, the controller 400 may control the first electrical connector 120 and/or the second electrical connector 210 so as to cause the first energy storage 110 of the cleaning apparatus 100 to supply power to the first base station 200 through the first electrical connector 120 and the second electrical connector 210.

Illustratively, the method may further include controlling the power consumer 220 of the first base station 200 to operate. For example, the waterway controller 221 is controlled to transport the liquid from the external water source 201 to the cleaning system, and/or transport the dirt in the cleaning system to the external drainage 202.

In some embodiments, in case a state of the cleaning apparatus 100 meets a water circulation condition, the cleaning apparatus 100 can be controlled to move to the first base station 200 to be docked with the first base station 200, and the first base station 200 can be controlled to carry out the water circulation operation on the cleaning apparatus 100, for example, the waterway controller 221 can be controlled to transport the liquid from the external water source 201 to the cleaning system, and the first base station 200 can be further controlled to transport the dirt in the cleaning system to the external sewage disposal device 202.

The water circulation operation includes, but is not limited to, at least one of: adding water, discharging water, and cleaning (including washing the mop and washing the wheel).

Illustratively, the state of the cleaning apparatus 100 meets the water circulation condition, including at least one of: a water volume in the clean water chamber 130 of the cleaning apparatus 100 being less than or equal to a first water volume threshold, a water volume in the recovery chamber 140 of the cleaning apparatus 100 being greater than or equal to a second water volume threshold, a cumulative workload of the cleaning apparatus 100 being greater than or equal to a workload threshold, and a water circulation instruction triggered by a user operation being received. For example, when there is less clean water left in the clean water chamber 130 and/or more dirt is contained in the recovery chamber 140, a water adding operation can be performed by the base station on the cleaning apparatus 100 and/or the dirt in the cleaning apparatus 100 can be transported to the external drainage 202. For example, in case the cleaning apparatus 100 has accumulatively cleaned floor of enough area/length after adding water, and/or the cleaning apparatus 100 has accumulatively cleaned enough dirt in cleaning the surface to be cleaned, maintenance can be performed on the cleaning apparatus 100 by the base station, such as cleaning the mop, adding water, etc. The controller 400 includes a human-computer interaction device such as a touch screen, through which a user operation can be detected and a water circulation instruction triggered according to the user operation can be obtained. Or, the controller 400 is capable of communicating with the user's terminal apparatus, such as a mobile phone, and can obtain the water circulation instruction triggered by the mobile phone according to the user's operation. When the water circulation instruction is received, a water circulation operation can be performed by the base station on the cleaning apparatus 100.

Illustratively, in case the state of the cleaning apparatus 100 meets the water circulation condition and power level of the first energy storage 110 of the cleaning apparatus 100 is greater than or equal to a first power level threshold, the cleaning apparatus 100 is controlled to move to the first base station 200 to be docked with the first base station 200. Only when the power level of the first energy storage 110 is enough to supply to the power consumer of the first base station for operations so that maintenance can be performed on the cleaning apparatus 100, the cleaning apparatus 100 is controlled to move to the first base station 200, thus ensuring normal operations of the first base station.

Illustratively, when the first electrical connector 120 and/or the second electrical connector 210 are controlled so that the first energy storage 110 supplies power to the first base station 200 through the first electrical connector 120 and the second electrical connector 210, the second energy storage 240 receives and stores electrical energy from the second electrical connector 210.

When the second electrical connector 210 is not coupled with the first electrical connector 120, the power consumer 220 can also operate based on the electrical energy stored in the second energy storage 240, for example, it can perform self-inspection, output status prompt information, communicate with the cleaning apparatus 100 and terminal apparatus, which, of course, is not limited thereto.

Figure 10:
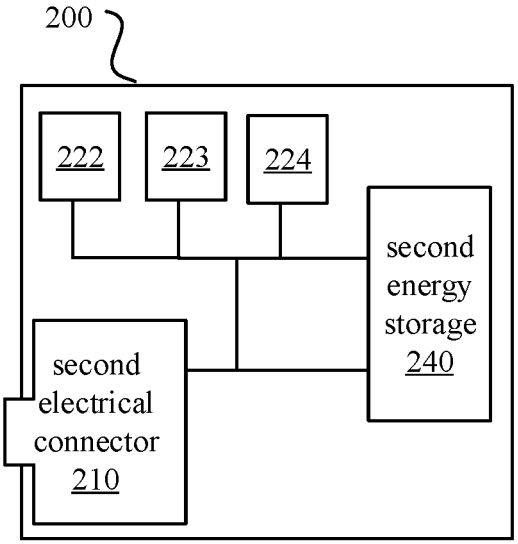
FIG. 10 is a schematic block diagram of a first base station in yet another embodiment.

In some embodiments, as shown in FIG. 10, the power consumer 220 includes at least one of: a detector 222, a display 223, and a communication assembly 224. The detector 222 includes at least one of: a water supply detector 222, a water level detector 222, an overflow detector 222, a dirt detector 222, and an apparatus docking detector 222. For example, the water supply detector 222 is configured to detect whether the external water source 201 supplies water, the water level detector 222 is configured to detect a water level of the clean water chamber 130 and/or the recovery chamber 140 of the cleaning apparatus 100, the overflow detector 222 is configured to detect whether the first base station 200 and/or the clean water chamber 130 overflows, and the apparatus docking detector 222 is configured to detect whether the first base station 200 is docked with the cleaning apparatus 100 to realize in-situ detection.

The method further includes obtaining detection information of the detector 222, and controlling the power consumer 220 to operate according to the detection information. For example, the detection information of the detector 222 can be displayed by the display 223, and in case at least one of conditions that the external water source 201 does not supply water, the water level of the clean water chamber 130 is greater than or equal to a first preset water level, the water level of the recovery chamber 140 is lower than a second preset water level, and the first base station 200 and/or the clean water chamber 130 overflows is met, a prompt information can be displayed by the display 223, and/or the prompt information is sent to the terminal apparatus through the communication assembly 224 and/or the prompt information is sent to the cleaning device 100 through the communication assembly 224. For example, when it is detected by the apparatus docking detector 222 that the cleaning apparatus 100 is docked with the first base station 200 so as to couple the first electrical connector 120 with the second electrical connector 210, the first electrical connector 120 and/or the second electrical connector 210 can be controlled so that the first energy storage 110 of the cleaning apparatus 100 can supply power to the power consumer 220 of the first base station 200 through the first electrical connector 120 and the second electrical connector 210, and the power consumer 220 of the first base station 200 is controlled to operate.

Figure 11:
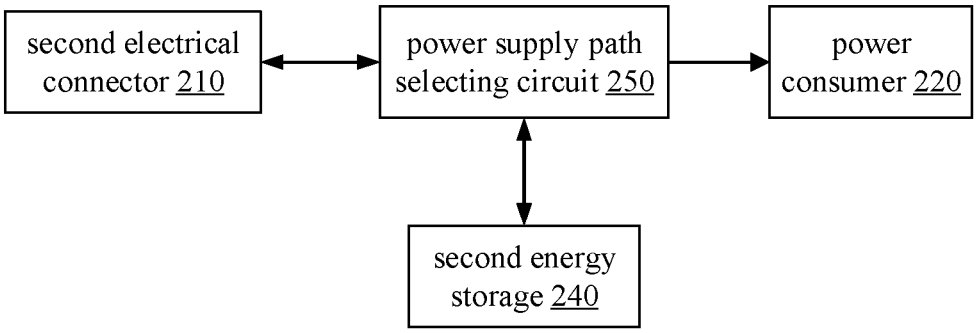
FIG. 11 is a schematic block diagram of a first base station in still another embodiment.

In some embodiments, as shown in FIG. 11, the first base station 200 further includes a power supply path selecting circuit 250. The power supply path selecting circuit 250 is connected with the second electrical connector 210, the second energy storage 240, and the power consumer 220. The power supply path selecting circuit 250 is configured to transmit electrical energy obtained by the second electrical connector 210 to the power consumer 220 and/or the second energy storage 240, and/or, the power supply path selecting circuit 250 is configured to transmit the electrical energy obtained by the second electrical connector 210 and/or the electrical energy stored by the second energy storage 240 to the power consumer 220.

The power supply path selecting circuit 250 includes, but is not limited to, a switching element, such as a metal-oxide-semiconductor field-effect transistor (MOSFET) element, and the power supply path can be controlled by switching a state of the switching element.

The controller 400 and/or the power supply path selecting circuit 250 may acquire information on remaining power level of the second energy storage 240. According to the information on the remaining power level of the second energy storage 240, the power supply path selecting circuit 250 is controlled to transmit the electrical energy obtained by the second electrical connector 210 to the second energy storage 240; and/or the power supply path selecting circuit 250 is controlled to transmit the electrical energy obtained by the second electrical connector 210 and/or the electrical energy stored by the second energy storage 240 to the power consumer 220. For example, when the remaining power level of the second energy storage 240 is greater than or equal to a first preset threshold, such as close to full power level, the power supply path selecting circuit 250 can be controlled to transmit the electrical energy obtained by the second electrical connector 210 and the electrical energy stored in the second energy storage 240 to the power consumer 220, so as to ensure sufficient power to be supplied to the power consumer 220. When the remaining power level of the second energy storage 240 is less than or equal to a second preset threshold, for example, when the remaining power level is less in amount, the power supply path selecting circuit 250 can be controlled to transmit the power obtained by the second electrical connector 210 to the second energy storage 240 so as to charge the second energy storage 240.

In some embodiments, referring to FIG. 9, in case the state of the cleaning apparatus 100 meets the charging condition, the cleaning apparatus 100 can be controlled to move to the second base station 300 to be docked with the second base station 300, or the user can be prompted to move the cleaning apparatus to the second base station to be docked with the second base station, so that the second base station 300 can charge the cleaning apparatus 100. Illustratively, the controller 400 can at least control the cleaning apparatus 100 to move to the first base station 200 or to prompt the user to move the cleaning apparatus 100 to the first base station 200 for the water circulation operation or other maintenance, or control the cleaning apparatus 100 to move to the second base station 300 or prompt the user to move the cleaning apparatus 100 to the second base station 300 for charging according to the state of the cleaning apparatus 100. The electrical energy stored by the cleaning apparatus 100 when being charged by the second base station 300 can be supplied to the first base station 200 in case it is docked with the first base station 200, and the first base station 200 does not need to be supplied with power separately, for example, without being connected to the commercial power, and thus the first base station can be disposed more flexibly and can be installed and used more conveniently. With the first base station providing water circulation for the cleaning apparatus, a water circulation component can be removed from the second base station, so that a structure of the second base station is simplified, with reduced size and cost. For example, the second base station can be a charging pile with a simple structure, which is convenient to install and use and can charge the cleaning apparatus. As such, the whole cleaning system is more convenient to install and use.

Illustratively, when the power level of the first energy storage 110 of the cleaning apparatus 100 is less than or equal to a second power level threshold, or a current cleaning task is completed (for example, a zone with a preset area, or one or more rooms has been cleaned; or the ground in the cleaning task map has been completely cleaned), or cleaning components of the cleaning apparatus 100 finish cleaning and have been dried (for example, the cleaning apparatus 100 is cleaned and dried at the first base station 200 after the ground of the cleaning task map is completely cleaned), it is determined that the state of the cleaning apparatus 100 meets the charging condition, and the cleaning apparatus 100 is controlled to move to the second base station 300 to be docked with the second base station 300.

Illustratively, in case the cleaning apparatus 100 is docked with the second base station 300 so as to couple the first electrical connector 120 of the cleaning apparatus 100 with the third electrical connector 310 of the second base station 300, the first electrical connector 120 and/or the third electrical connector 310 are controlled to allow the second base station 300 to supply the electrical energy of the commercial power to the first energy storage 110 of the cleaning apparatus 100 through the third electrical connector 310 and the first electrical connector 120. For example, the cleaning apparatus 100 can communicate with the first base station 200 and the second base station 300, for example, in case the cleaning apparatus 100 is docked with the corresponding base station, communication via electrical signals or in a wireless manner can be made. Alternatively, the communication in the wireless manner can be made at any time as desired. Therefore, the controller 400 on the cleaning apparatus 100 can also control the corresponding base station, for example, control the power consumer of the first base station 200 to operate, or control a power supply circuit of the second base station 300 to operate.

Figure 12:
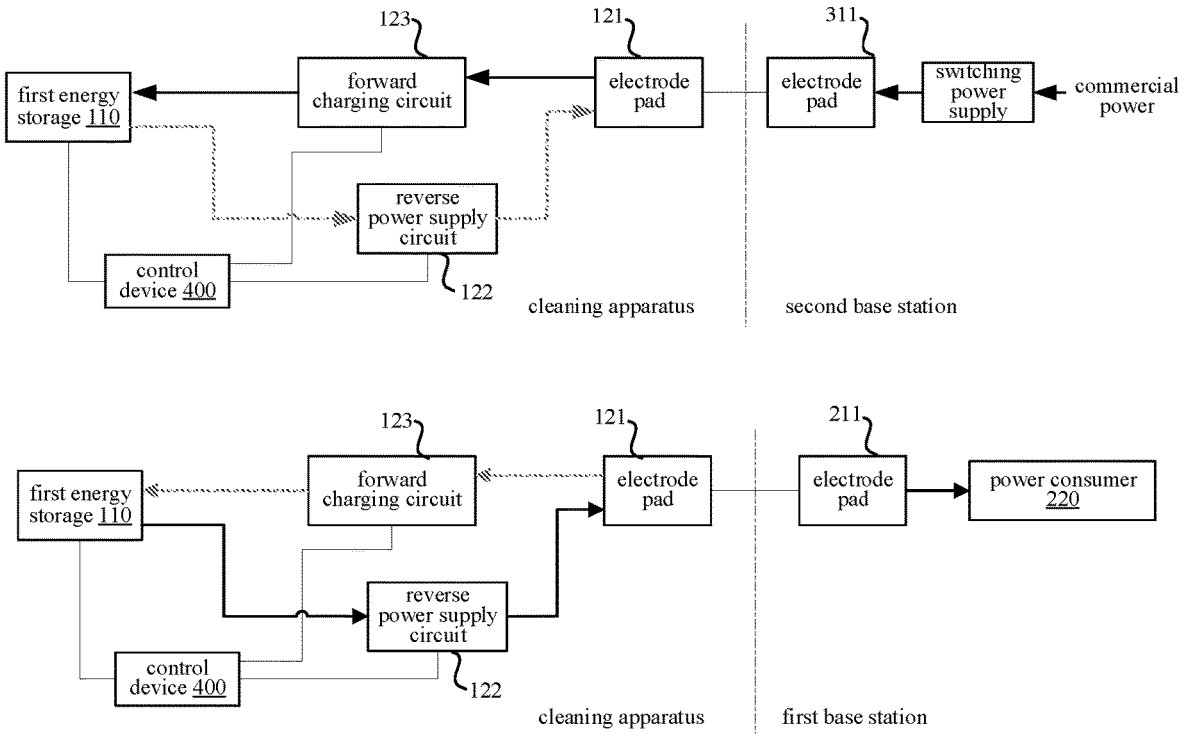
FIG. 12 is a schematic block diagram of a cleaning system in some embodiments.
Figure 13:
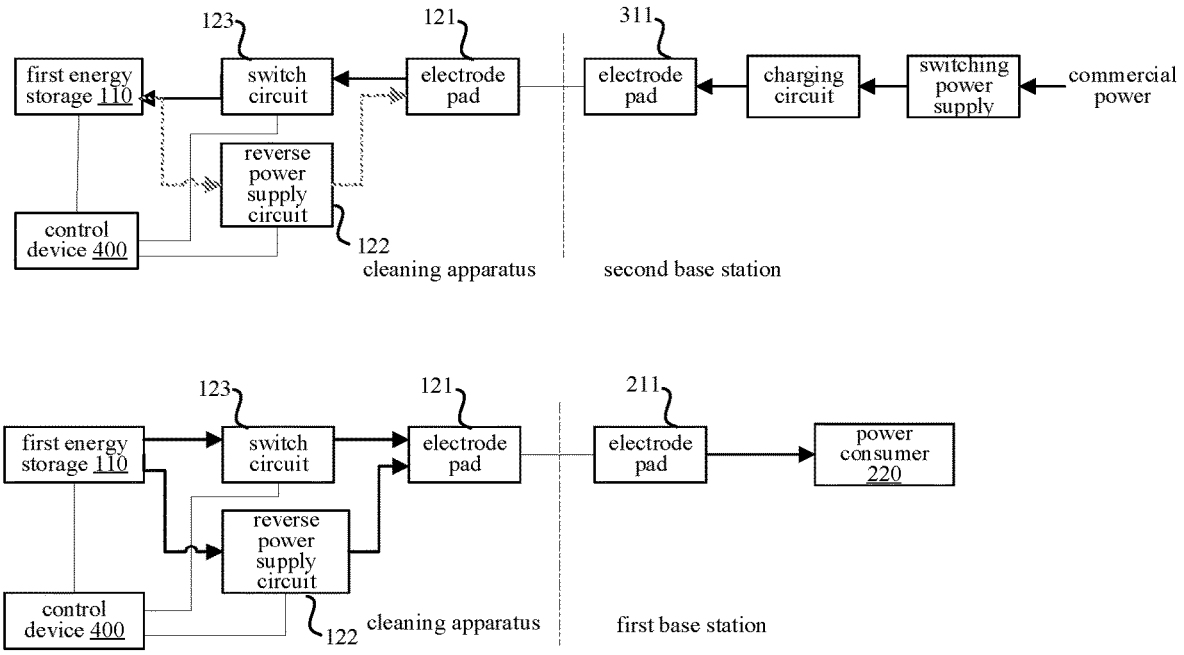
FIG. 13 is a schematic block diagram of a cleaning system in some embodiments.

In some embodiments, as shown in FIG. 12 and FIG. 13, the first electrical connector 120 includes a first electrical connection part 121, a first electrical energy transmission circuit 122, and a second electrical energy transmission circuit 123. The first electrical connection part 121 includes, for example, an electrical connection part capable of conducting, such as an electrode pad and a conductive post, or the charging part 111 as described above. Both the first electrical energy transmission circuit 122 and the second electrical energy transmission circuit 123 are connected with the first electrical connection part 121 and the first energy storage 110, and the first electrical energy transmission circuit 122, when engaged, is configured to output electrical energy of the first energy storage 110 through the first electrical connection part 121, and the second electrical energy transmission circuit 123, when engaged, is configured to output the electrical energy obtained by the first electrical connection part 121 to the first energy storage 110.

Illustratively, the second electrical connector 210 includes a second electrical connection part 211, and the third electrical connector 310 includes a third electrical connection part 311. The second electrical connection part 211 and the third electrical connection part 311 include, for example, electrical connection parts functioning in conducting, such as electrode pads and conductive posts.

Illustratively, the first electrical energy transmission circuit 122 is configured to output electrical energy of the first energy storage 110 through the first electrical connection part 121 in case the first electrical connection part 121 is coupled with the second electrical connection part 211. The second electrical energy transmission circuit 123 is configured to output electrical energy obtained by the first electrical connection part 121 to the first energy storage 110 in case the first electrical connection part 121 is coupled with the third electrical connection part 311. In the present disclosure, implementations of the first electrical energy transmission circuit 122 and the second electrical energy transmission circuit 123 are not limited, as long as the cleaning apparatus 100 can not only output the electrical energy of the first energy storage 110 to the first base station 200 through the first electrical connection part 121, but also store the electrical energy obtained from the second base station 300 to the first energy storage 110 through the first electrical connection part 121.

Illustratively, referring to FIG. 12, the first electrical energy transmission circuit 122 includes a reverse power supply circuit. The reverse power supply circuit includes but is not limited to at least one of: a switch circuit, a voltage stabilizing circuit, and a motor driving circuit. The motor driving circuit is configured to drive the waterway controller 221 such as the valve and/or the pump in the first base station 200, for example. The second electrical energy transmission circuit 123 includes a forward charging circuit which has a function of charging the first energy storage 110, such as, charging a battery.

The controller 400 is configured to control the first electrical energy transmission circuit 122 to be engaged and the second electrical energy transmission circuit 123 to be disengaged in case the first electrical connection part 121 is coupled with the second electrical connection part 211, to allow the first electrical energy transmission circuit 122 to output the electrical energy of the first energy storage 110 to the first base station 200 through the first electrical connection part 121; and control the second electrical energy transmission circuit 123 to be engaged and the first electrical energy transmission circuit 122 to be disengaged in case the first electrical connection part 121 is coupled with the third electrical connection part 311, to allow the second electrical energy transmission circuit 123 to output the electrical energy obtained by the first electrical connection part 121 from the second base station 300 to the first energy storage 110.

Illustratively, referring to FIG. 13, the second electrical energy transmission circuit 123 includes a switch circuit. The switch circuit is configured, for example, to allow electrical energy to flow in a direction from the first energy storage 110 to the first electrical connection part 121 via the first electrical energy transmission circuit 122 when switched off; to allow electrical energy to flow in a direction from the first electrical connection part 121 to the first energy storage 110 via the switching circuit when switched on. For example, in case the first electrical connection part 121 is coupled with the second electrical connection part 211, the controller 400 controls the switch circuit of the second electrical energy transmission circuit 123 to be switched off, so that the first electrical energy transmission circuit 122 outputs the electrical energy of the first energy storage 110 to the first base station 200 through the first electrical connection part 121. In case the first electrical connection part 121 is coupled with the third electrical connection part 311, the switch circuit of the second electrical energy transmission circuit 123 is controlled to be switched on, so that the second electrical energy transmission circuit 123 outputs the electrical energy obtained by the first electrical connection part 121 from the second base station 300 to the first energy storage 110.

Figure 14:
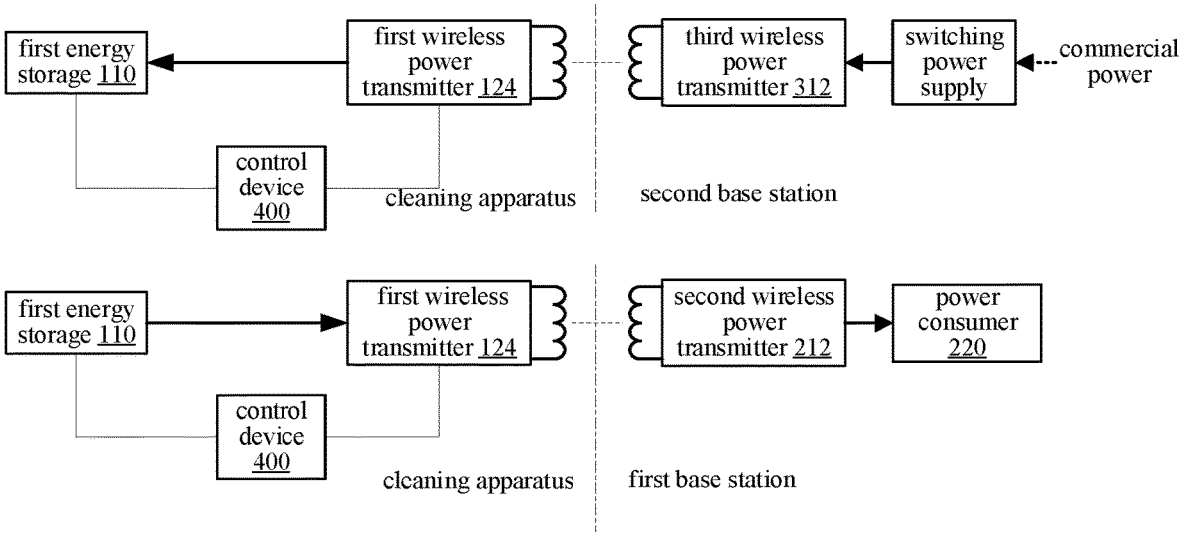
FIG. 14 is a schematic block diagram of a cleaning system in some embodiments.

In some other embodiments, a wireless power transmission mode, that is, a non-contact power transmission is adopted between the cleaning apparatus 100 and the first base station 200 and/or the second base station 300. Referring to FIG. 14, the first electrical connector 120 includes a first wireless power transmitter 124. The first wireless power transmitter 124 is connected with the first energy storage 110 of the cleaning apparatus 100. The second electrical connector 210 includes a second wireless power transmitter 212, and the third electrical connector 310 includes a third wireless power transmitter 312. Illustratively, at least the first wireless power transmitter 124 has functions of wirelessly transmitting and receiving electrical energy; the second wireless power transmitter 212 has a function of receiving electrical energy wirelessly, and the third wireless power transmitter 312 has a function of transmitting electrical energy wirelessly. The first, second, or third power transmitter may include, for example, a coil, which is prior art and will not be repeated here.

Illustratively, the first wireless power transmitter 124 is configured to output the electrical energy of the first energy storage 110 to the second wireless power transmitter 212 when the first wireless power transmitter 124 is electromagnetically coupled with the second wireless power transmitter 212, so that the second wireless power transmitter 212 can supply power to the power consumer 220 of the first base station 200.

For example, the controller 400 is configured to control the first wireless power transmitter 124 and/or the second wireless power transmitter 212 when the first wireless power transmitter 124 is electromagnetically coupled with the second wireless power transmitter 212, so that the first wireless power transmitter 124 outputs the electrical energy of the first energy storage 110 to the second wireless power transmitter 212, and thus the second wireless power transmitter 212 can supply power to the power consumer 220 of the first base station 200.

Illustratively, the first wireless power transmitter 124 is configured to obtain the electrical energy output by the third wireless power transmitter 312 and output the obtained electrical energy to the first energy storage 110, when the first wireless power transmitter 124 is electromagnetically coupled with the third wireless power transmitter 312.

For example, the controller 400 is configured to control the first wireless power transmitter 124 and/or the third wireless power transmitter 312 when the first wireless power transmitter 124 is electromagnetically coupled with the third wireless power transmitter 312, to allow the first wireless power transmitter 124 to obtain the electrical energy output by the third wireless power transmitter 312 and output the obtained electrical energy to the first energy storage 110.

Illustratively, referring to FIG. 12 to FIG. 14, the second base station 300 further includes a switching power supply and/or a charging circuit. The switching power supply and/or the charging circuit is configured to convert the commercial power into electrical energy with a preset voltage and/or a preset current, which is output through the third electrical connector 310, for example, to the cleaning apparatus 100. For example, the switching power supply converts the commercial power into electrical energy with the preset voltage and/or the preset current, and the charging circuit serve to adjust the voltage and/or current output to the cleaning apparatus 100 according to parameters such as the remaining power and a temperature of the first energy storage 110 in the cleaning apparatus 100.

In some embodiments, the cleaning apparatus 100 can transmit electrical energy with the first base station 200 and the second base station 300 through the first wireless power transmitter 124, and can also transmit data to realize communication. Therefore, the controller 400 on the cleaning apparatus 100 can also control the corresponding base station, for example, control the power consumption apparatus of the first base station 200 to operate or control a power supply circuit of the second base station 300 to operate.

The cleaning system provided in the embodiments of the disclosure at least includes a cleaning apparatus for cleaning a surface to be cleaned and a first base station for being used in cooperation with the cleaning apparatus. The cleaning apparatus includes a first energy storage and a first electrical connector connected with the first energy storage, and the first base station includes a second electrical connector and a power consumer connected with the second electrical connector. In case the cleaning apparatus is docked with the first base station to couple the first electrical connector with the second electrical connector, the first energy storage supplies power to the first base station through the first electrical connector and the second electrical connector. In case the cleaning apparatus is docked with the first base station, it can supply electrical energy stored therein to the first base station, and the first base station can be powered without a socket. In addition, it is not necessary for the first base station to be provided with an AC-DC adapter, with low cost and reduced occupied space and weight, and thus the first base station can be disposed more flexibly and can be installed and used more conveniently.

In some embodiments, the first base station may further include a solar power generator. The solar power generator is connected with the power consumer of the first base station, and is configured to convert solar energy into electrical energy and provide the electrical energy to the power consumer. The solar power generator can also provide the electrical energy to the second energy storage of the first base station. In such a way, ability of the first base station to obtain electrical energy can be improved, and operation reliability can be improved.

Figure 15:
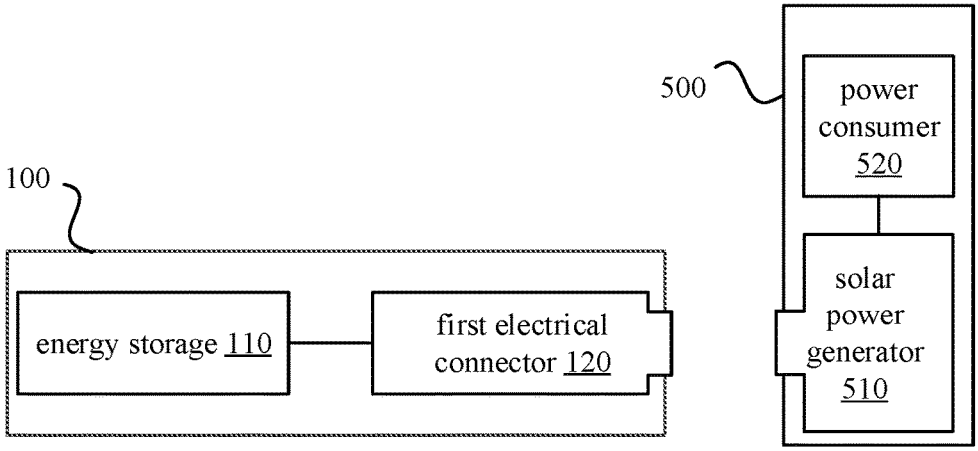
FIG. 15 is a schematic block diagram of a cleaning system in some embodiments.

Referring to FIG. 15 and in combination with the embodiments described above, a base station 500 and a cleaning system including the base station 500 and the cleaning apparatus 100 described above are further provided in the embodiments of the present disclosure. The base station 500 is configured to be used in cooperate with the cleaning apparatus 100. The base station 500 according to the embodiment of the present disclosure includes a solar power generator 510 and a power consumer 520 connected with the solar power generator 510. The solar power generator 510 is configured to convert solar energy into electrical energy and provide the solar energy to the power consumer 520. Illustratively, the power consumer 520 can refer to the power consumer 220 of the first base station 200, which is not be described here again. It is not necessary to supply power to the base station 500 separately, so the base station 500 is safer, and the base station 500 can be disposed more flexibly and can be installed and used more conveniently. In addition, the base station 500 does not need an AC-DC adapter, with low cost and reduced occupied space and weight.

Figure 16:
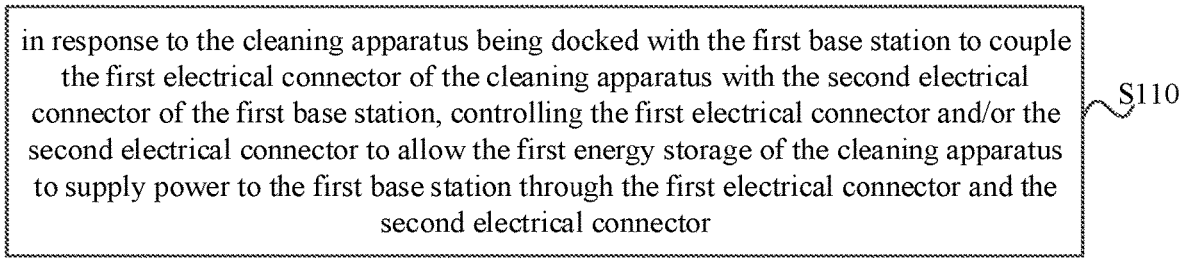
FIG. 16 is a flow chart of a control method of a cleaning system in some embodiments.

Referring to FIG. 16 and in combination with the embodiments described above, a control method of a cleaning system is further provided in an embodiment of the disclosure, which is applied to the cleaning system described above.

As shown in FIG. 16, the control method of the cleaning system includes a step S110.

In step S110, in case the cleaning apparatus is docked with the first base station to couple the first electrical connector of the cleaning apparatus with the second electrical connector of the first base station, the first electrical connector and/or the second electrical connector are controlled to allow the first energy storage of the cleaning apparatus to supply power to the first base station through the first electrical connector and the second electrical connector.

The first base station includes a power consumer connected with the second electrical connector. A step in which the first electrical connector and/or the second electrical connector are controlled to allow the first energy storage of the cleaning apparatus to supply power to the first base station through the first electrical connector and the second electrical connector includes:

controlling the first electrical connector and/or the second electrical connector to allow the first energy storage of the cleaning apparatus to supply power to the power consumer of the first base station through the first electrical connector and the second electrical connector, so that the power consumer of the first base station can operate.

The first base station includes a power consumer and a second energy storage connected with the second electrical connector and the power consumer respectively. The step in which the first electrical connector and/or the second electrical connector are controlled to allow the first energy storage of the cleaning apparatus to supply power to the first base station through the first electrical connector and the second electrical connector includes:

controlling the first electrical connector and/or the second electrical connector to allow the first energy storage of the cleaning apparatus to supply power to the second energy storage of the first base station through the first electrical connector and the second electrical connector, so that the second energy storage stores the electrical energy from the cleaning apparatus and supplies power to the power consumer.

In some embodiments, the first base station includes a cleaning area.

The first base station includes a liquid inputting path fluidly communicated the external water source and the cleaning area, and the power consumer includes a pump and/or a valve provided in the liquid inputting path. The method further includes controlling the pump and/or valve of the liquid inputting path to input the liquid from the external water source into the cleaning area through the liquid inputting path; and/or The first base station includes a liquid discharge path fluidly communicated the cleaning area and the external drainage, and the power consumer includes a pump and/or a valve provided in the liquid discharge path. The method further includes controlling the pump and/or the valve of the liquid discharge path to output the dirt in the cleaning area to the external drainage through the liquid discharge path.

In some embodiments, the cleaning apparatus includes a clean water chamber for storing clean water, the first base station includes a liquid inputting path fluidly communicated the external water source and the clean water chamber, and the power consumer includes a pump and/or a valve provided in the liquid inputting path. The method further includes controlling the pump and/or valve of the liquid inputting path to input the liquid from the external water source into the clean water chamber of the cleaning apparatus through the liquid inputting path; and/or the cleaning apparatus includes a recovery chamber for storing dirt, the first base station includes the liquid discharge path fluidly communicated the recovery chamber and the external drainage, and the power consumer includes a pump and/or a valve provided in the liquid discharge path. The method further includes controlling the pump and/or valve of the liquid discharge path to output the dirt in the recovery chamber of the cleaning apparatus to the external drainage through the liquid discharge path.

In some embodiments, the cleaning apparatus includes a clean water chamber for storing clean water. The method further includes controlling the pump and/or valve of the liquid inputting path to input the liquid from the external water source into the clean water chamber of the cleaning apparatus through the liquid inputting path; and/or the cleaning apparatus includes a recovery chamber for storing dirt. The method further includes controlling the pump and/or valve of the liquid discharge path to output the dirt in the recovery chamber of the cleaning apparatus to the external drainage through the liquid discharge path.

The power consumer includes at least one of: a detector, a display, and a communication assembly. The detector includes at least one of: a water supply detector, a water level detector, an overflow detector, a dirt detector, and an apparatus docking detector.

The method further includes: obtaining detection information of the detector, and controlling the power consumer to operate according to the detection information.

In some embodiments, the first base station further includes a power supply path selecting circuit. The power supply path selecting circuit is connected with the second electrical connector, the second energy storage, and the power consumer.

The control method further includes:

obtaining information on remaining power of the second energy storage;

controlling the power supply path selecting circuit to transmit the electrical energy obtained by the second electrical connector to the second energy storage based on the information on the remaining power of the second energy storage; and/or controlling the power supply path selecting circuit to transmit the electrical energy obtained by the second electrical connector and/or the electrical energy stored in the second energy storage to the power consumer.

In some embodiments, the control method further includes:

in response to at least one of the following: the water volume in the clean water chamber of the cleaning apparatus being less than or equal to the first water volume threshold, the water volume in the recovery chamber of the cleaning apparatus being greater than or equal to the second water volume threshold, the cumulative workload of the cleaning apparatus being greater than or equal to the workload threshold, and the water circulation instruction triggered by a user being received, the cleaning apparatus is controlled to move to the first base station to be docked with the first base station, or the user is prompted to move the cleaning apparatus to the first base station to be docked with the first base station.

Alternatively, in response to the power level of the first energy storage of the cleaning apparatus being greater than or equal to a first power level threshold and at least one of the following: the water volume in the clean water chamber of the cleaning apparatus being less than or equal to the first water volume threshold, the water volume in the recovery chamber of the cleaning apparatus being greater than or equal to the second water volume threshold, the cumulative workload of the cleaning apparatus being greater than or equal to the workload threshold, and the water circulation instruction triggered by the user being received, the cleaning apparatus is controlled to move to the first base station to be docked with the first base station, or the user is prompted to move the cleaning apparatus to the first base station to be docked with the first base station.

In some embodiments, the cleaning system further includes a second base station including a third electrical connector, and the second base station can be connected with the commercial power.

The method further includes:

in response to the cleaning apparatus being docked with the second base station to couple the first electrical connector of the cleaning apparatus with the third electrical connector of the second base station, controlling the first electrical connector and/or the third electrical connector to allow the second base station to supply the electrical energy of the commercial power to the first energy storage of the cleaning apparatus through the third electrical connector and the first electrical connector.

In some embodiments, the first electrical connector includes a first electrical connection part, a first electrical energy transmission circuit, and a second electrical energy transmission circuit. The first electrical energy transmission circuit and the second electrical energy transmission circuit are respectively connected with the first electrical connection part and the first energy storage, and the first electrical energy transmission circuit, when engaged, is configured to output the electrical energy of the first energy storage through the first electrical connection part, and the second electrical energy transmission circuit, when engaged, is configured to output the electrical energy obtained by the first electrical connection part to the first energy storage.

A step in which the first electrical connector and/or the second electrical connector are controlled to allow the first energy storage to supply power to the power consumer of the first base station through the first electrical connector and the second electrical connector includes: controlling the first electrical energy transmission circuit to be engaged and controlling the second electrical energy transmission circuit to be disengaged; and/or A step in which the first electrical connector and/or the third electrical connector are controlled to allow the second base station to supply the electrical energy of the commercial power to the first energy storage of the cleaning apparatus through the third electrical connector and the first electrical connector includes controlling the second electrical energy transmission circuit to be engaged and controlling the first electrical energy transmission circuit to be disengaged.

In some embodiments, the first electrical connector includes a first wireless power transmitter, and the first wireless power transmitter is connected with a first energy storage of the cleaning apparatus.

The second electrical connector includes a second wireless power transmitter, and the step in which the first electrical connector and/or the second electrical connector are controlled to allow the first energy storage to supply power to the power consumer of the first base station through the first electrical connector and the second electrical connector includes: controlling the first wireless power transmitter and/or the second wireless power transmitter to allow the first wireless power transmitter to output the electrical energy of the first energy storage to the second wireless power transmitter, so that the second wireless power transmitter supplies power to the power consumer of the first base station; and/or the third electrical connector includes a third wireless power transmitter, and the step in which the first electrical connector and/or the third electrical connector are controlled to allow the second base station to supply the electrical energy of the commercial power to the first energy storage of the cleaning apparatus through the third electrical connector and the first electrical connector includes controlling the first wireless power transmitter and/or the third wireless power transmitter to allow the first wireless power transmitter to obtain the electrical energy output by the third wireless power transmitter and outputting the obtained electrical energy to the first energy storage.

In some embodiments, the method further includes:

controlling the cleaning apparatus to move to the second base station to be docked with the second base station, or prompting a user to move the cleaning apparatus to the second base station to be docked with the second base station in case a state of the cleaning apparatus meets a charging condition, to allow the second base station to charge the cleaning apparatus.

In the control method of the cleaning system according to the embodiments of the disclosure, when the cleaning apparatus is docked with the first base station to couple the first electrical connector of the cleaning apparatus with the second electrical connector of the first base station, the first electrical connector and/or the second electrical connector are controlled so that the first energy storage of the cleaning apparatus supplies power to the first base station through the first electrical connector and the second electrical connector. The first base station can be powered without a socket. In addition, it is not necessary to provide an AC-DC adapter for the first base station, with low cost and reduced occupied space and weight, and thus the first base station can be disposed more flexibly and can be installed and used more conveniently.

Figure 17:
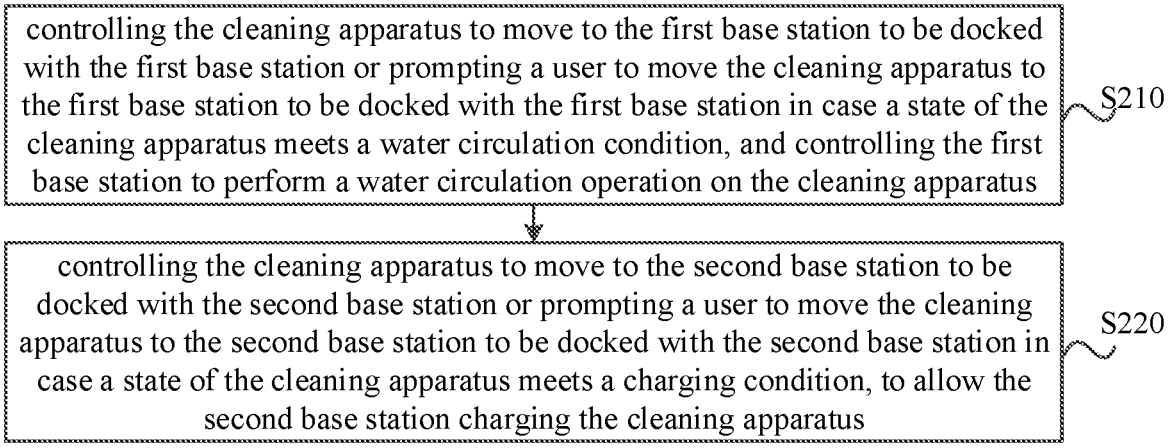
FIG. 17 is a flow chart of a control method of a cleaning system in some embodiments.

Referring to FIG. 17 and in combination with the embodiments described above, a control method of a cleaning system is further provided in an embodiment of the disclosure, which is applied to the cleaning system. The cleaning system includes a cleaning apparatus, a first base station, and a second base station. The second base station can be connected with the commercial power.

As shown in FIG. 17, the control method of the cleaning system includes steps S210 to S220.

In step S210, in case of a state of the cleaning apparatus meeting a water circulation condition, the cleaning apparatus is controlled to move to the first base station to be docked with the first base station, or a user is prompt to move the cleaning apparatus to the first base station to be docked with the first base station, and the first base station is controlled to perform a water circulation operation on the cleaning apparatus.

In step S220, in case of a state of the cleaning apparatus meeting a charging condition, the cleaning apparatus is controlled to move to the second base station to be docked with the second base station, or a user is prompt to move the cleaning apparatus to the second base station to be docked with the second base station, so that the second base station can charge the cleaning apparatus.

In some embodiments, the controller can identify a status of the cleaning apparatus, and control the cleaning apparatus to move to the first base station or the second base station or prompt the user to move the cleaning apparatus to the first base station or the second base station according to needs of the cleaning apparatus. The controller can also control a corresponding base station to complete corresponding functions in case the cleaning apparatus is docked with the corresponding base station, such as performing the water circulation operation on the cleaning apparatus at the first base station or charging the cleaning apparatus at the second base station.

Reference is made to FIG. 18 and in combination with embodiments described above, which is a schematic block diagram of the controller 400 according to the embodiment of the present disclosure. The controller 400 includes a processor 401 and a memory 402.

Illustratively, the processor 401 and the memory 402 are connected by a bus, such as an Inter-integrated Circuit (I2C) bus.

In particular, the processor 401 may be a Micro-controller Unit (MCU), a Central Processing Unit (CPU), a Digital Signal Processor (DSP), or the like.

In particular, the memory 402 can be a Flash chip, a Read-Only Memory (ROM) disk, an optical disk, a U flash disk, or a mobile hard disk.

The processor 401 is configured to execute computer executable instructions stored in the memory 402, and when the computer executable instructions is executed, steps of the method of any of the above-described embodiments are implemented.

Illustratively, the processor 401 is configured to execute computer executable instructions stored in the memory 402, and when executing the computer executable instructions, following steps are implemented:

in case the cleaning apparatus is docked with the first base station to couple the first electrical connector of the cleaning apparatus with the second electrical connector of the first base station, controlling the first electrical connector and/or the second electrical connector to allow the first energy storage of the cleaning apparatus to supply power to the first base station through the first electrical connector and the second electrical connector.

Illustratively, the processor 401 is configured to execute computer executable instructions stored in the memory 402, and when executing the computer executable instructions, following steps are implemented:

in case a state of the cleaning apparatus meets a water circulation condition, controlling the cleaning apparatus to move to the first base station to be docked with the first base station, or prompting a user to move the cleaning apparatus to the first base station to be docked with the first base station, and controlling the first base station to perform a water circulation operation on the cleaning apparatus; and in case a state of the cleaning apparatus meets a charging condition, controlling the cleaning apparatus to move to the second base station to be docked with the second base station, or prompting a user to move the cleaning apparatus to the second base station to be docked with the second base station, so that the second base station can charge the cleaning apparatus.

The specific principle and implementation mode of the controller of the present disclosure are similar to those of the embodiments described above, which is not described herein.

A computer-readable storage medium is provided by the present disclosure. The computer-readable storage medium stores computer executable instructions, which, when executed by a processor, causes the processor to implement steps of the method in any of the embodiments described above.

The computer-readable storage medium can be an internal storage unit of the controller described in any of the embodiments described above, such as a hard disk or a memory of the controller. The computer-readable storage medium can also be an external storage device for the controller, such as a plug-in hard disk, a Smart Media Card (SMC), a Secure Digital (SD) card, a Flash Card, etc. provided on the controller.

It should also be understood that terms used in this disclosure are only for a purpose of describing specific embodiments and are not intended to limit the disclosure.

It should be understood that a term "and/or" used in this disclosure and the appended claims refers to any combination and all possible combinations of one or more of the associated listed items, and includes these combinations.

The above is only specific implementations of this disclosure, but a protection scope of this disclosure is not limited to this. Various equivalent modifications or substitutions can easily occur to any technical personnel familiar with the art within a technical scope of the present disclosure, and these modifications or substitutions should be encompassed in the protection scope of this disclosure. Therefore, the protection scope of this disclosure shall be subject to the protection scope of claims.

What is claimed is:

1. A cleaning system, comprising: a cleaning apparatus for cleaning a surface to be cleaned, the cleaning apparatus comprising a first energy storage and a first electrical connector connected with the first energy storage; a first base station configured to be in cooperation with the cleaning apparatus, the first base station comprising a second electrical connector, a power consumer and being configured to: be in fluid communication with an external water source to allow liquid from the external water source to be input into the cleaning system; and/or be in fluid communication with an external drainage to output dirt in the cleaning system to the external drainage; and a second base station comprising a third electrical connector, the second base station being capable of being connected with commercial power; wherein in case the cleaning apparatus is docked with the first base station to couple the first electrical connector with the second electrical connector, the first energy storage is configured to supply power to the first base station through the first electrical connector and supply power to the power consumer connected with the second electrical connector; and in case the cleaning apparatus is docked with the second base station to couple the first electrical connector with the third electrical connector, the second base station supplies electrical energy of the commercial power to the first energy storage of the cleaning apparatus through the third electrical connector and the first electrical connector.

2. The cleaning system according to claim 1, wherein the first base station comprises the power consumer and a second energy storage, and the second energy storage is connected with the second electrical connector and the power consumer, and in case the cleaning apparatus is docked with the first base station to couple the first electrical connector with the second electrical connector, the first energy storage is capable of supplying power to the second energy storage of the first base station through the first electrical connector and the second electrical connector, to allow the second energy storage to store electrical energy from the cleaning apparatus and to be capable of supplying power to the power consumer.

3. The cleaning system according to claim 1, wherein the first base station comprises a cleaning area;

the first base station comprises a liquid inputting path fluidly communicated to the external water source and the cleaning area, the power consumer comprises a pump and/or a valve provided in the liquid inputting path, and the pump and/or the valve is configured to control the liquid from the external water source to be input into the cleaning area through the liquid inputting path; and/or the first base station comprises a liquid discharge path fluidly communicated to the cleaning area and the external drainage, the power consumer comprises a pump and/or a valve provided in the liquid discharge path, and the pump and/or the valve is configured to control dirt in the cleaning area to be output to the external drainage through the liquid discharge path.

4. The cleaning system according to claim 1, wherein the cleaning apparatus comprises a clean water chamber for storing clean water, the first base station comprises a liquid inputting path fluidly communicated to the external water source and the clean water chamber, the power consumer comprises a pump and/or a valve provided in the liquid inputting path, and the pump and/or the valve is configured to input liquid from the external water source into the clean water chamber of the cleaning apparatus through the liquid inputting path; and/or the cleaning apparatus comprises a recovery chamber for storing dirt, the first base station comprises a liquid discharge path fluidly communicated to the recovery chamber and the external drainage, the power consumer comprises a pump and/or a valve provided in the liquid discharge path, and the pump and/or the valve is configured to output dirt in the recovery chamber of the cleaning apparatus to the external drainage through the liquid discharge path.

5. The cleaning system according to claim 3, wherein the cleaning apparatus comprises a clean water chamber for storing clean water, the liquid inputting path is further configured to be fluidly communicated to the external water source and the clean water chamber, and the pump and/or valve is further configured to input liquid from the external water source into the clean water chamber of the cleaning apparatus through the liquid inputting path; and/or the cleaning apparatus comprises a recovery chamber for storing dirt, the liquid discharge path is further configured to be fluidly communicated to the recovery chamber and the external drainage, and the pump and/or valve is further configured to output the dirt in the recovery chamber of the cleaning apparatus to the external drainage through the liquid discharge path.

6. The cleaning system according to claim 2, wherein the first base station further comprises a power supply path selecting circuit, the power supply path selecting circuit being connected with the second electrical connector, the second energy storage, and the power consumer;

the power supply path selecting circuit is configured to transmit electrical energy obtained by the second electrical connector to the power consumer and/or the second energy storage; and/or the power supply path selecting circuit is configured to transmit the electrical energy obtained by the second electrical connector and/or electrical energy stored in the second energy storage to the power consumer.

7. The cleaning system according to claim 1, wherein the first electrical connector comprises a first electrical connection part, a first electrical energy transmission circuit, and a second electrical energy transmission circuit, wherein both the first electrical energy transmission circuit and the second electrical energy transmission circuit are connected with the first electrical connection part and the first energy storage, the first electrical energy transmission circuit, when engaged, is configured to output the electrical energy of the first energy storage through the first electrical connection part, and the second electrical energy transmission circuit, when engaged, is configured to output the electrical energy obtained by the first electrical connection part to the first energy storage; and the cleaning system further comprises a controller for controlling the first electrical energy transmission circuit to be engaged and the second electrical energy transmission circuit to be disengaged when the first electrical connection part is coupled with the second electric connector; and for controlling the second electrical energy transmission circuit to be engaged and the first electrical energy transmission circuit to be disengaged when the first electrical connection part is coupled with the third electric connector.

8. The cleaning system according to claim 1, wherein the first electrical connector comprises a first wireless power transmitter connected with the first energy storage of the cleaning apparatus, and the cleaning system further comprises a controller;

the second electrical connector comprises a second wireless power transmitter, and the controller is configured to control the first wireless power transmitter and/or the second wireless power transmitter when the first wireless power transmitter is electromagnetically coupled with the second wireless power transmitter, to allow the first wireless power transmitter to output the electrical energy of the first energy storage to the second wireless power transmitter, so as to allow the second wireless power transmitter to supply power to the power consumer of the first base station; and/or the third electrical connector comprises a third wireless power transmitter, and the controller is configured to control the first wireless power transmitter and/or the third wireless power transmitter when the first wireless power transmitter is electromagnetically coupled with the third wireless power transmitter, to allow the first wireless power transmitter to obtain the electrical energy output by the third wireless power transmitter and outputting the obtained electrical energy to the first energy storage.

9. A control method of the cleaning system of claim 1, the control method comprising:

in response to the cleaning apparatus being docked with the first base station to couple the first electrical connector of the cleaning apparatus with the second electrical connector of the first base station, controlling the first electrical connector and/or the second electrical connector to allow the first energy storage of the cleaning apparatus to supply power to the first base station through the first electrical connector and the second electrical connector; and in response to the cleaning apparatus being docked with the second base station to couple the first electrical connector of the cleaning apparatus with the third electrical connector of the second base station, controlling the first electrical connector and/or the third electrical connector to allow the second base station to supply electrical energy of the commercial power to the first energy storage of the cleaning apparatus through the third electrical connector and the first electrical connector.

10. The control method according to claim 9, wherein the first base station comprises a power consumer connected with the second electrical connector; and the controlling the first electrical connector and/or the second electrical connector to allow the first energy storage of the cleaning apparatus to supply power to the first base station through the first electrical connector and the second electrical connector comprises:

controlling the first electrical connector and/or the second electrical connector to allow the first energy storage of the cleaning apparatus to supply power to the power consumer of the first base station through the first electrical connector and the second electrical connector, to allow the power consumer of the first base station to work.

11. The control method according to claim 9, wherein the first base station comprises the power consumer and a second energy storage, and the second energy storage is connected with the second electrical connector and the power consumer, the controlling the first electrical connector and/or the second electrical connector to allow the first energy storage of the cleaning apparatus to supply power to the first base station through the first electrical connector and the second electrical connector comprises:

controlling the first electrical connector and/or the second electrical connector to allow the first energy storage of the cleaning apparatus to supply power to the second energy storage of the first base station through the first electrical connector and the second electrical connector, to allow the second energy storage to store the electrical energy from the cleaning apparatus and supplying power to the power consumer.

12. The control method according to claim 10, wherein the first base station comprises a cleaning area;

the first base station comprises a liquid inputting path fluidly communicated to the external water source and the cleaning area, the power consumer comprises a pump and/or a valve provided in the liquid inputting path, and the method further comprises controlling the pump and/or valve of the liquid inputting path to input the liquid from the external water source into the cleaning area through the liquid inputting path; and/or the first base station comprises a liquid discharge path fluidly communicated to the cleaning area and the external drainage, and the power consumer comprises a pump and/or a valve provided in the liquid discharge path; and the method further comprises controlling the pump and/or the valve of the liquid discharge path to output the dirt in the cleaning area to the external drainage through the liquid discharge path.

13. The control method according to claim 10, wherein the cleaning apparatus comprises a clean water chamber for storing clean water, the first base station comprises a liquid inputting path fluidly communicated to the external water source and the clean water chamber, and the power consumer comprises a pump and/or a valve provided in the liquid inputting path; and the method further comprises controlling the pump and/or valve of the liquid inputting path to input the liquid from the external water source into the clean water chamber of the cleaning apparatus through the liquid inputting path; and/or the cleaning apparatus comprises a recovery chamber for storing dirt, the first base station comprises a liquid discharge path fluidly communicated to the recovery chamber and the external drainage, and the power consumer comprises a pump and/or a valve provided in the liquid discharge path; the method further comprises controlling the pump and/or valve of the liquid discharge path to output the dirt in the recovery chamber of the cleaning apparatus to the external drainage through the liquid discharge path.

14. The control method according to claim 12, wherein the cleaning apparatus comprises a clean water chamber for storing clean water, the method further comprises controlling the pump and/or valve of the liquid inputting path to input the liquid from the external water source into the clean water chamber of the cleaning apparatus through the liquid inputting path; and/or the cleaning apparatus comprises a recovery chamber for storing dirt, and the method further comprises controlling the pump and/or valve of the liquid discharge path to output the dirt in the recovery chamber of the cleaning apparatus to the external drainage through the liquid discharge path.

15. The control method according to claim 11, wherein the first base station further comprises a power supply path selecting circuit, the power supply path selecting circuit being connected with the second electrical connector, the second energy storage, and the power consumer;

the control method further comprises:

obtaining information on remaining power of the second energy storage;

controlling the power supply path selecting circuit to transmit the electrical energy obtained by the second electrical connector to the second energy storage based on the information on the remaining power of the second energy storage; and/or controlling the power supply path selecting circuit to transmit the electrical energy obtained by the second electrical connector and/or electrical energy stored in the second energy storage to the power consumer.

16. The control method according to claim 9, wherein the control method further comprises:

in response to at least one of the following: a water volume in the clean water chamber of the cleaning apparatus being less than or equal to a first water volume threshold, a water volume in the recovery chamber of the cleaning apparatus being greater than or equal to a second water volume threshold, a cumulative workload of the cleaning apparatus being greater than or equal to a workload threshold, or a water circulation instruction triggered by an user being received, controlling the cleaning apparatus to move to the first base station to be docked with the first base station, or prompting the user to move the cleaning apparatus to the first base station to be docked with the first base station;

or, in response to a power level of the first energy storage of the cleaning apparatus being greater than or equal to a first power level threshold and at least one of the following: the water volume in the clean water chamber of the cleaning apparatus being less than or equal to the first water volume threshold, the water volume in the recovery chamber of the cleaning apparatus being greater than or equal to the second water volume threshold, the cumulative workload of the cleaning apparatus being greater than or equal to the workload threshold, or the water circulation instruction triggered by the user being received, controlling the cleaning apparatus to move to the first base station to be docked with the first base station, or the user is prompted to move the cleaning apparatus to the first base station to be docked with the first base station.

17. The control method according to claim 9, wherein the first electrical connector comprises a first electrical connection part, a first electrical energy transmission circuit, and a second electrical energy transmission circuit, wherein both the first electrical energy transmission circuit and the second electrical energy transmission circuit are connected with the first electrical connection part and the first energy storage, and the first electrical energy transmission circuit, when engaged, is configured to output electrical energy of the first energy storage through the first electrical connection part, and the second electrical energy transmission circuit, when engaged, is configured to output electrical energy obtained by the first electrical connection part to the first energy storage; and the controlling the first electrical connector and/or the second electrical connector to allow the first energy storage to supply power to the power consumer of the first base station through the first electrical connector and the second electrical connector comprises: controlling the first electrical energy transmission circuit to be engaged and controlling the second electrical energy transmission circuit to be disengaged; and/or controlling the first electrical connector and/or the third electrical connector to allow the second base station to supply the electrical energy of the commercial power to the first energy storage of the cleaning apparatus through the third electrical connector and the first electrical connector comprises: controlling the second electrical energy transmission circuit to be engaged and controlling the first electrical energy transmission circuit to be disengaged.

18. The control method according to claim 9, wherein the first electrical connector comprises a first wireless power transmitter, and the first wireless power transmitter is connected with the first energy storage of the cleaning apparatus;

the second electrical connector comprises a second wireless power transmitter, and the controlling the first electrical connector and/or the second electrical connector to allow the first energy storage to supply power to the power consumer of the first base station through the first electrical connector and the second electrical connector comprises: controlling the first wireless power transmitter and/or the second wireless power transmitter to allow the first wireless power transmitter to output electrical energy of the first energy storage to the second wireless power transmitter, to allow the second wireless power transmitter to supply power to the power consumer of the first base station; and/or the third electrical connector comprises a third wireless power transmitter, and the controlling the first electrical connector and/or the third electrical connector to allow the second base station to supply the electrical energy of the commercial power to the first energy storage of the cleaning apparatus through the third electrical connector and the first electrical connector comprises: controlling the first wireless power transmitter and/or the third wireless power transmitter to allow the first wireless power transmitter to obtain electrical energy output by the third wireless power transmitter and outputting the obtained electrical energy to the first energy storage.

* * * * *